US007563356B2

(12) United States Patent
Nabeya et al.

(10) Patent No.: US 7,563,356 B2
(45) Date of Patent: Jul. 21, 2009

(54) COMPOSITE PROCESSING APPARATUS AND METHOD

(75) Inventors: Osamu Nabeya, Tokyo (JP); Takayuki Saito, Fujisawa (JP); Tsukuru Suzuki, Fujisawa (JP); Yasushi Toma, Fujisawa (JP); Ikutaro Noji, Tokyo (JP)

(73) Assignee: Ebara Corporation, Tokyo (JP)

( * ) Notice: Subject to any disclaimer, the term of this patent is extended or adjusted under 35 U.S.C. 154(b) by 404 days.

(21) Appl. No.: 10/549,324

(22) PCT Filed: Mar. 12, 2004

(86) PCT No.: PCT/JP2004/003279

§ 371 (c)(1),
(2), (4) Date: Sep. 16, 2005

(87) PCT Pub. No.: WO2004/083494

PCT Pub. Date: Sep. 30, 2004

(65) Prior Publication Data

US 2006/0175191 A1 Aug. 10, 2006

(30) Foreign Application Priority Data

Mar. 19, 2003 (JP) ..... 2003-076500

(51) Int. Cl.
*C25F 3/16* (2006.01)
*B23H 5/08* (2006.01)

(52) U.S. Cl. ..... 205/661; 205/663

(58) Field of Classification Search ..... 205/661, 205/663

See application file for complete search history.

(56) References Cited

U.S. PATENT DOCUMENTS 6,328,872 B1 12/2001 Talieh et al.

(Continued)

FOREIGN PATENT DOCUMENTS

JP 2-95574 4/1990

(Continued)

*Primary Examiner*—Harry D. Wilkins, III
*Assistant Examiner*—Nicholas A. Smith
(74) *Attorney, Agent, or Firm*—Wenderoth, Lind & Ponack, L.L.P.

(57) ABSTRACT

A composite processing apparatus which can securely process a conductive material, such as a copper film, at a low surface pressure and a high rate while effectively preventing the formation of pits is disclosed. The composite processing apparatus includes: a substrate holder for holding a substrate; a processing table including a mechanical processing section for processing a surface of the substrate by a processing method involving a mechanical action; and an electrolytic processing section which is separate from the mechanical processing section. The electrolytic processing section includes a processing electrode with an ion exchanger, for processing the substrate by applying a voltage between the processing electrode and the substrate while keeping the ion exchanger (92) in contact with the substrate. The composite processing apparatus also includes a liquid supply section for supplying a liquid between the substrate and the processing electrode, and between the substrate and the mechanical processing section; and a drive section for moving the substrate and the processing table relative to each other.

1 Claim, 18 Drawing Sheets

U.S. PATENT DOCUMENTS

| | | | | |
|---|---|---|---|---|
| 6,354,916 | B1 * | 3/2002 | Uzoh et al. | 451/41 |
| 7,074,113 | B1 * | 7/2006 | Moore | 451/28 |
| 2002/0020630 | A1 | 2/2002 | Mori et al. | |
| 2002/0070126 | A1 | 6/2002 | Sato et al. | |

FOREIGN PATENT DOCUMENTS

| | | | |
|---|---|---|---|
| JP | 2002-93761 | | 3/2002 |
| JP | 2002-292523 | | 10/2002 |
| WO | WO02103771 | A1 * | 12/2002 |

* cited by examiner

COMPOSITE PROCESSING APPARATUS AND METHOD

CROSS-REFERENCE TO RELATED APPLICATION

This application is a National Stage Entry of International Application Number PCT/JP04/03279, filed Mar. 12, 2004. The disclosure of the prior application is hereby incorporated herein in its entirety by reference.

BACKGROUND OF THE INVENTION

1. Field of the Invention

The present invention relates to a composite processing apparatus and method, and more particularly to a composite processing apparatus and method useful for flattening a surface of an electric conductor (conductive material), such as copper, embedded in fine interconnect recesses provided in a surface of a substrate, in particular a semiconductor wafer, thereby forming embedded interconnects.

2. Description of the Related Art

In recent years, instead of using aluminum or aluminum alloys as a material for forming circuits on a substrate such as a semiconductor wafer, there is an eminent movement towards using copper (Cu) which has a low electric resistivity and high electromigration resistance. Copper interconnects are generally formed by filling copper into fine recesses formed in a surface of a substrate. Various techniques are known for forming such copper interconnects, including chemical vapor deposition (CVD), sputtering, and plating. According to any such technique, a copper film is formed in the substantially entire surface of a substrate, followed by removal of unnecessary copper by chemical mechanical polishing (CMP).

FIGS. 1A through 1C illustrate a sequence of steps in an example process for forming such a substrate W having copper interconnects. As shown in FIG. 1A, an insulating film 2, such as an oxide film of $SiO_2$ or a film of low-k material, is deposited on a conductive layer 1*a* on a semiconductor base 1 on which semiconductor devices are formed. Contact holes 3 and trenches 4 are formed in the insulating film 2 by performing a lithography/etching technique. Thereafter, a barrier layer 5 of TaN or the like is formed on the insulating film 2, and a seed layer 7, as an electric supply layer for electroplating, is formed on the barrier layer 5 by sputtering, CVD, or the like.

Then, as shown in FIG. 1B, copper plating is performed on the surface of the substrate W to fill the contact holes 3 and the trenches 4 with copper; and, at the same time, a copper film 6 is deposited on the insulating film 2. Thereafter, the copper film 6, the seed layer 7 and the barrier layer 5 on the insulating film 2 are removed by chemical mechanical polishing (CMP) so as to make the surface of the copper film 6 filled in the contact holes 3 and the trenches 4, and the surface of the insulating film 2 lie substantially on the same plane. Interconnects composed of the copper film 6 are thus formed in the insulating film 2, as shown in FIG. 1C.

Components in various types of equipment have recently become finer and have required higher accuracy. As submicron manufacturing technology is becoming common, the properties of materials are more and more influenced by the processing method. Under these circumstances, in a conventional machining method in which a desired portion in a workpiece is physically destroyed and removed from a surface thereof by a tool, a large number of defects may be produced to deteriorate the properties of the workpiece. Therefore, it becomes important to perform processing without deteriorating the properties of the materials.

Some processing methods, such as chemical polishing, electrolytic processing and electrolytic polishing, have been developed in order to solve this problem. In contrast, with the conventional physical processing, these methods perform removal processing or the like through chemical dissolution reaction. Therefore, these methods do not suffer from defects, such as formation of a damaged layer and dislocation, due to plastic deformation, so that processing can be performed without deteriorating the properties of the materials.

An electrolytic processing method using an ion exchanger has been developed. This method comprises bringing an ion exchanger mounted on a processing electrode and an ion exchanger mounted on a feeding electrode into contact with or close to a workpiece, and applying a voltage from a power source to between the processing electrode and the feeding electrode while supplying a liquid, such as ultrapure water, between the processing and feeding electrodes and the workpiece from a liquid supply section to carry out removal processing of a surface layer of the workpiece.

Such a conventional electrolytic processing using an ion exchanger involves the following problems. A processed material is taken in the ion exchanger during electrolytic processing, and there is a limit on the take-in amount of processed material per unit time. Further, there is a need for regeneration or a change of the ion exchanger, which will lower the throughput. In the case of electrolytic processing (polishing) of a copper film using an ion exchanger and electrodes (a processing electrode and a feeding electrode), copper is considered to be directly taken in the ion exchanger. In some cases, however, a passive film of e.g. $Cu_2O$ or CuO is formed in the surface of a copper film during electrolytic processing. Such a passive film is physically soft and is non-conductive and, therefore, poorly removed by electrolytic processing. The conventional electrolytic processing also entails the problem of the formation of pits (small holes) in a processed surface of a workpiece depending upon the type of the workpiece, the processing conditions, and the like.

A chemical mechanical polishing (CMP) process, for example, generally necessitates a complicated operation and control, and needs a considerably long processing time. In addition, a sufficient post-cleaning of a polished surface must be conducted after the polishing treatment. This also imposes a considerable load on the slurry or cleaning liquid waste. Accordingly, there is a strong demand for omitting CMP entirely or reducing the load upon CMP. Also in this connection, it is to be pointed out that though a low-k material which has a low dielectric constant is expected to be predominantly used in the future as a material for the insulating film, the low-k material has a low mechanical strength and, therefore, has difficulty enduring the stress applied during CMP processing. Thus, also from this standpoint, there is a demand for a process that enables the flattening of a substrate without giving any stress thereto.

Further, a method has been reported which performs CMP processing simultaneously with plating, viz. chemical mechanical electrolytic polishing. According to this method, the mechanical processing is carried out to the growing surface of a plating film, causing the problem of denaturing of the resulting film.

In the case of the above-mentioned conventional electrolytic processing or electrolytic polishing, the process proceeds through an electrochemical interaction between a workpiece and an electrolytic solution (aqueous solution of NaCl, $NaNO_3$, HF, HCl, $HNO_3$, NaOH, etc.). Though a glossy surface or mirror surface can be formed with these methods, a uniform or even surface of sub-micron level cannot be obtained. This holds true for composite electrolytic polishing for electrolytically polishing using a slurry of an electrolytic solution containing abrasive grains.

SUMMARY OF THE INVENTION

The present invention has been made in view of the above situation in the prior art. It is therefore a first object of the present invention to provide a composite processing apparatus and method which can securely process a conductive material, such as a copper film, at a low surface pressure and a high rate while effectively preventing the formation of pits.

It is a second object of the present invention to provide a composite processing apparatus and method which can flatly process a surface conductive material of a substrate or remove (clean off) extraneous matter from a surface of a workpiece, such as a substrate, thus entirely eliminating CMP processing or minimizing the load on CMP processing.

In order to achieve the above objects, the present invention provides a composite processing apparatus comprising: a substrate holder for holding a substrate; a processing table including a mechanical processing section for processing a surface of the substrate by a processing method involving a mechanical action, and an electrolytic processing section, provided separately from the mechanical processing section and having a processing electrode provided with an ion exchanger, for processing the substrate by applying a voltage between the processing electrode and the substrate while keeping the ion exchanger in contact with the substrate; a liquid supply section for supplying a liquid between the substrate and the processing electrode, and between the substrate and the mechanical processing section; and a drive section for moving the substrate and the processing table relative to each other.

According to this composite processing apparatus, a physically soft and non-conductive passive film, which is formed in a surface of a substrate during processing by the electrolytic processing section, can be removed by the mechanical processing section, and subsequently the processed surface can be re-processed by the electrolytic processing section. This enables a low-surface pressure, high-rate processing. Further, by mechanically processing the substrate surface with the mechanical processing section, gas bubbles adhering to the substrate surface can also be removed together with the passive film. This can prevent the formation of pits which would be caused by the adhesion of gas bubbles to the substrate surface.

In a preferred embodiment of the present invention, during the relative movement between the substrate and the processing table, the processing electrode passes a portion of the substrate to be processed which is held by the substrate holder, and the mechanical processing section subsequently passes the portion of the substrate to be processed.

Electrolytic processing with the electrolytic processing section and mechanical processing with the mechanical processing section can thus be carried out alternately and successively.

Preferably, the mechanical processing section passes the portion of the substrate to be processed within one second after the processing electrode has passed the portion to be processed.

This enables a passive film, which is formed in the surface of the substrate during processing by the processing electrode of the electrolytic processing section, to be removed promptly by mechanical processing of the mechanical processing section, thereby flattening the surface of the substrate.

The mechanical processing section may have a processing surface composed of a fixed abrasive.

This makes it possible to carry out electrolytic processing with the electrolytic processing section and mechanical processing with the mechanical processing section simultaneously and, thereby, obtain the benefits of electric processing and the benefits of mechanical processing with a fixed abrasive by solely using pure water as a processing liquid, i.e. without using a slurry containing abrasive grains. This can facilitate post-processing, such as cleaning, of the substrate and treatment of the waste liquid.

The mechanical processing section may have a processing surface composed of a polishing pad, and a slurry supply section for supplying a slurry to the processing surface.

In a preferred embodiment of the present invention, the processing table includes a number of processing electrodes, a number of mechanical processing sections, and a number of feeding electrodes for feeding electricity to the substrate. The processing electrodes and the feeding electrodes are disposed alternately at regular intervals, and each processing electrode is disposed between adjacent mechanical processing sections.

Preferably, the processing table makes a scroll movement (i.e., translational movement).

In a preferred embodiment of the present invention, the processing table has a disk-like shape, the processing electrode extends in the radial direction of the processing table, and the feeding electrodes for feeding electricity to the substrate are disposed on both sides of the processing electrode.

The present invention provides another composite processing apparatus comprising: a substrate holder for holding a substrate; a processing table including a fixed-abrasive processing section for polishing a surface of the substrate by a processing method involving a mechanical action by a fixed abrasive containing abrasive grains, and an electrolytic processing section, separately provided from the fixed-abrasive processing section and having a processing electrode, for processing the substrate by applying a voltage between the processing electrode and the substrate; a drive section for moving the substrate and the processing table relative to each other; and a liquid supply section for supplying a liquid between the substrate and the processing electrode, and between the substrate and the fixed abrasive.

The present invention provides a composite processing method comprising: separately providing a mechanical processing section for processing a surface of a substrate by a processing method involving a mechanical action, and an electrolytic processing section, having a processing electrode provided with an ion exchanger, for processing the substrate by applying a voltage between the processing electrode and the substrate while keeping the ion exchanger in contact with the substrate; and carrying out processing of a surface of a substrate by moving the substrate and the mechanical processing section relative to each other, and moving the substrate and the processing electrode relative to each other.

The present invention provides yet another composite processing apparatus comprising: a holder for holding a workpiece; a fixed-abrasive processing section for processing a surface of the workpiece by a processing method involving a mechanical action by a fixed abrasive containing abrasive grains; an electrolytic processing section, having a processing electrode capable of coming close to the workpiece and a feeding electrode for feeding electricity to the workpiece, for processing the workpiece by applying a voltage between the processing electrode and the feeding electrode; a power source for applying the voltage between the processing electrode and the feeding electrode; a liquid supply section for supplying a liquid between the workpiece and the processing electrode and/or the feeding electrode, and/or between the workpiece and the fixed-abrasive processing section; and a drive section for moving the workpiece and the fixed-abrasive processing section relative to each other, and moving the workpiece and the electrolytic processing section relative to each other.

FIG. 2 illustrates the mechanism of processing according to the present invention. In FIG. 2 is shown a processing system in which a fixed abrasive 14 of a fixed-abrasive processing section 12 is disposed in contact with a surface of a workpiece 10; and an electrolytic processing section 20, including a processing electrode 16 capable of coming close to the workpiece 10 and a feeding electrode 18, is disposed such that the processing electrode 16 is close to the surface of the workpiece 10 and the feeding electrode 18 is in contact with the surface of the workpiece 10. A liquid 26, such as an electrolytic solution, is supplied from a liquid supply section 24 to between the processing electrode 16, the feeding electrode 18 and the workpiece 10 while applying a voltage from a power source 22 between the processing electrode 16 and the feeding electrode 18. The liquid 26 used in the system may be a common electrolytic solution that is generally employed in conventional electrolytic processing. The concentration, type, etc. of the electrolytic solution are not particularly limited and may be appropriately selected depending on the workpiece 10.

Either the workpiece 10, or at least one of the processing electrode 16, the feeding electrode 18 and the fixed abrasive 14, or both of them are moved so that the surface of the workpiece 10 in contact with the fixed abrasive 14 is mechanically polished, while the surface of the workpiece 10 facing the processing electrode 16 is electrolytically processed. Mechanical processing by the fixed-abrasive processing section 12 and electrochemical processing by the electrolytic processing section 20 are thus carried out simultaneously.

In a conventional composite electrolytic polishing process using a slurry-like electrolytic solution containing abrasive grains, extensive cleaning of the workpiece is necessary after electrolytic processing in order to remove impurities, such as abrasive grains, adhering to the workpiece. According to the present invention, the use of the fixed abrasive 14 containing abrasive grains therein can materially reduce the load on cleaning.

In a preferred embodiment of the present invention, the processing electrode and/or the feeding electrode is provided with an ion exchanger to be disposed between the electrode and the workpiece.

FIG. 3A shows a processing system in which an ion exchanger 28*a* is mounted on the workpiece 10 side surface of a processing electrode 16, an ion exchanger 28*b* is mounted on the workpiece 10 side surface of a feeding electrode 18, and the ion exchangers 28*a*, 28*b* have been brought into contact with a surface of a workpiece 10. FIG. 3B shows a processing system in which the ion exchanger 28*a* is mounted only on the workpiece 10 side surface of the processing electrode 16, and the ion exchanger 28*a* and the feeding electrode 18 have been brought into contact with a surface of a workpiece 10. Similarly, as in the above-described system, a liquid 26, which in these systems may be ultrapure water, is supplied from a liquid supply section 24 between the processing electrode 16, and between the feeding electrode 18 and the workpiece 10 while applying a voltage from the power source 22 to between the processing electrode 16 and the feeding electrode 18, and moving the workpiece 10 relative to the fixed-abrasive processing section and the electrolytic processing section, thereby carrying out mechanical polishing with the fixed abrasive 14 of the fixed-abrasive processing section 12 and electrochemical processing with the processing electrode 16 of the electrolytic processing section 20 simultaneously.

The ion exchangers 28*a*, 28*b*, mounted to the processing and feeding electrodes 16 and 18 according to necessity, can promote the dissociation of water molecules into hydrogen ions and hydroxide ions, thus increasing the dissociation amount of water molecules. This enables electrolytic processing using ultrapure water or the like as a processing liquid.

In a preferred embodiment of the present invention, during the relative movement between the workpiece and the fixed-abrasive processing section, and the relative movement between the workpiece and the electrolytic processing section, the fixed-abrasive processing section passes a portion of the workpiece to be processed which is held by the substrate holder, and the electrolytic processing section subsequently passes the portion of the workpiece to be processed.

Defects such as scratches and pits, produced in the surface of the workpiece by mechanical polishing with the fixed abrasive, can be removed by electrolytic processing.

In a preferred embodiment of the present invention, the composite processing apparatus includes at least two types of the fixed-abrasive processing section comprising fixed abrasives having different surface roughnesses.

This makes it possible to carry out processing of a workpiece by processing the workpiece with a fixed-abrasive processing section comprising a fixed abrasive having a large surface roughness, and shifting the processing to processing with a fixed-abrasive processing section comprising a fixed abrasive having a small surface roughness, so as to obtain a scratch-free processed surface.

The fixed abrasive preferably has a surface roughness of not more than 10 μm.

Mechanical polishing with a fixed abrasive involves the formation of defects, such as scratches having a depth, pits, etc. in a surface of a workpiece. Preferably, the defects should be of such a degree as can be removed by electrolytic processing. It has been confirmed that polishing of a copper surface with a fixed abrasive having a surface roughness of 10 μm, as carried out at a surface pressure of 10 psi (69 KPa), produces scratches having a depth of about 0.3 to 0.5 μm in the copper surface. Polishing of a copper surface at the same surface pressure but using a fixed abrasive having a surface roughness of 5 μm produces scratches having a depth of about 0.2 to 0.3 μm. The depth of scratches that can be removed by electrolytic processing is around 0.3 μm, preferably less than 0.3 μm. Accordingly, in order to carry out the most uniform mechanical polishing with a fixed abrasive and obtain a cleaner processed surface by electrolytic processing, the grain size of the abrasive grains contained in the fixed abrasive are desirably not more than 10 μm.

Pure water, a liquid having an electric conductivity of not more than 500 μS/cm or an electrolytic solution may be used as the liquid.

"Pure water" refers to water having an electric conductivity (at 1 atm and 2.5° C.) of not more than 10 μS/cm, for example. When pure water, more preferably a liquid (e.g. ultrapure water) having an electric conductivity of not more than 0.1 μS/cm, is used, a layer having a function of uniformly suppressing migration of ions is formed at the interface between a workpiece and e.g. an ion exchanger. The formation of such a layer can moderate the concentration of ion exchange (dissolution of metal), thereby improving the flatness of the processed surface.

The use of pure water or the like in carrying out electrolytic processing enables clean processing without any impurities on the processed surface, and can therefore simplify a cleaning process after electrolytic processing.

Preferably, an ion exchanger is disposed between the processing electrode and the workpiece, and a separate ion exchanger is disposed between the feeding electrode and the workpiece.

This can prevent a short circuit between the processing electrode and the feeding electrode, and can enhance the processing efficiency.

Preferably, a pressure of not more than 10 psi (69 kPa) is applied between the workpiece and at least one of the processing electrode, the feeding electrode and the fixed abrasive.

A force applied to the electrodes (processing electrode and feeding electrode) or to the fixed abrasive acts as a surface pressure on the workpiece. The processing rate and the processing profile are determined especially by the pressure between the processing electrode and the workpiece or the pressure between the fixed abrasive and the workpiece. For a relatively soft metal, such as copper interconnects, or a porous low-k material, it is desirable to apply a low surface pressure so as to suppress the formation of scratches.

The present invention mainly uses electrolytic processing (electrochemical processing), which involves little formation of scratches, and uses mechanical processing with a fixed abrasive as an auxiliary means to provide fine scratches in a surface of a workpiece. Thus, a fixed abrasive is not used for mechanical polishing. By providing fine scratches in the entire surface of a workpiece by mechanical processing with a fixed abrasive, a local concentration of electric field in electrolytic processing can be moderated, thus enabling uniform, highly-flat processing.

The depth of scratches provided in a workpiece is determined by the surface roughness of the fixed abrasive and the surface pressure. As described above, the depth of scratches provided in a copper surface can be made not more than about 0.3 to 0.5 μm by carrying out polishing at a surface pressure of not more than 10 psi using a fixed abrasive having a surface roughness of not more than 10 μm.

In a preferred embodiment of the present invention, the fixed-abrasive processing section and/or the electrolytic processing section moves closer to or away from the workpiece.

According to this embodiment, for example, after processing a workpiece with the fixed-abrasive processing section by bringing it into contact with the workpiece, the fixed-abrasive processing section and/or the electrolytic processing section is so moved as to process the workpiece only with the electrolytic processing section.

The present invention provides yet another composite processing apparatus comprising: a holder for holding a workpiece; a mechanical processing section for processing a surface of the workpiece by a processing method involving a mechanical action; an electrolytic processing section, having a processing electrode provided with an ion exchanger and capable of coming close to the workpiece and a feeding electrode for feeding electricity to the workpiece, for processing the workpiece by applying a voltage between the processing electrode and the feeding electrode; a liquid supply section for supplying a liquid between the workpiece and the electrolytic processing section, and/or between the workpiece and the mechanical processing section; and a drive section for moving the workpiece and the mechanical processing section relative to each other, and moving the workpiece and the electrolytic processing section relative to each other.

The present invention provides another composite processing method comprising: providing a fixed-abrasive processing section for processing a surface of a workpiece by a processing method involving a mechanical action by a fixed abrasive containing abrasive grains, and an electrolytic processing section, having a processing electrode and a feeding electrode, for processing the workpiece by applying a voltage between the processing electrode and the feeding electrode; and carrying out processing of a surface of a workpiece by moving the workpiece and the fixed-abrasive processing section relative to each other, and moving the workpiece and the electrolytic processing section relative to each other.

After processing the workpiece with the fixed-abrasive processing section by bringing it into contact with the workpiece, the workpiece may be processed only with the electrolytic processing section.

The present invention provides yet another composite processing method comprising: providing a mechanical processing section for processing a surface of a workpiece by a processing method involving a mechanical action, and an electrolytic processing section, having a processing electrode provided with an ion exchanger, for processing the workpiece by applying a voltage between the processing electrode and the workpiece while keeping the ion exchanger in contact with the workpiece; and carrying out processing of a surface of a workpiece by moving the workpiece and the mechanical processing section relative to each other, and moving the workpiece and the electrolytic processing section relative to each other.

DETAILED DESCRIPTION OF THE INVENTION

Preferred embodiments of the present invention will now be described with reference to the drawings. The following embodiments relate to application of the present invention to a composite processing apparatus for processing (polishing) a substrate used as the workpiece. The present invention, however, is of course applicable to other workpieces.

Figure 1A:
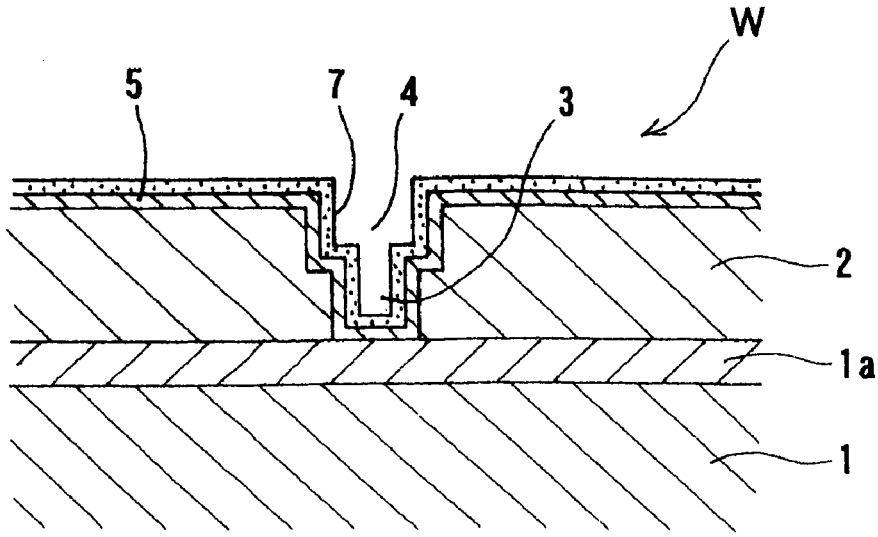
FIGS. 1A through 1C are diagrams illustrating a sequence of steps in an example process for forming a substrate having copper interconnects.
Figure 1B:
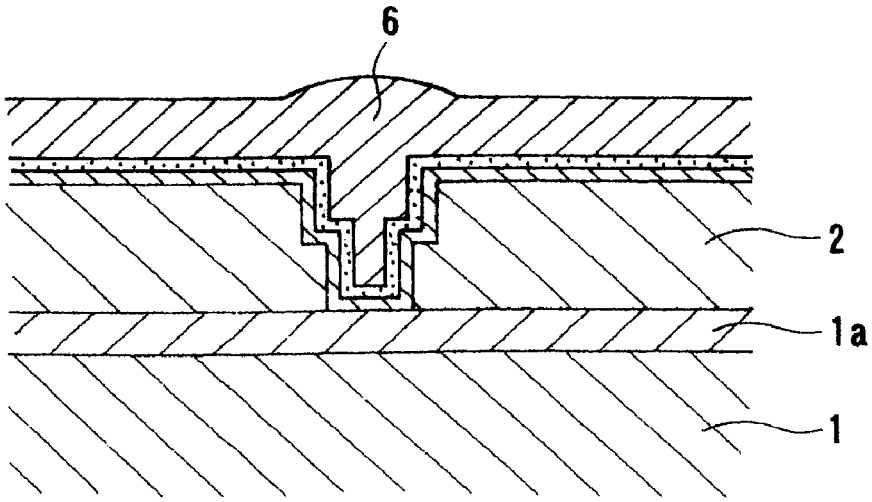
Figure 1C:
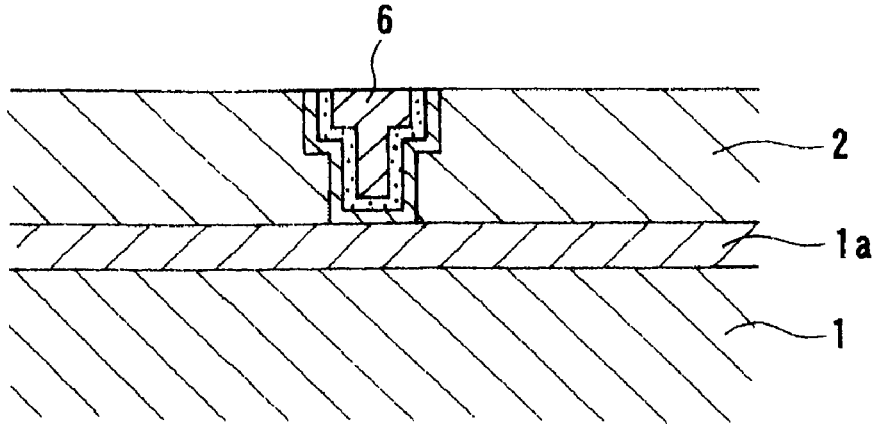
Figure 2:
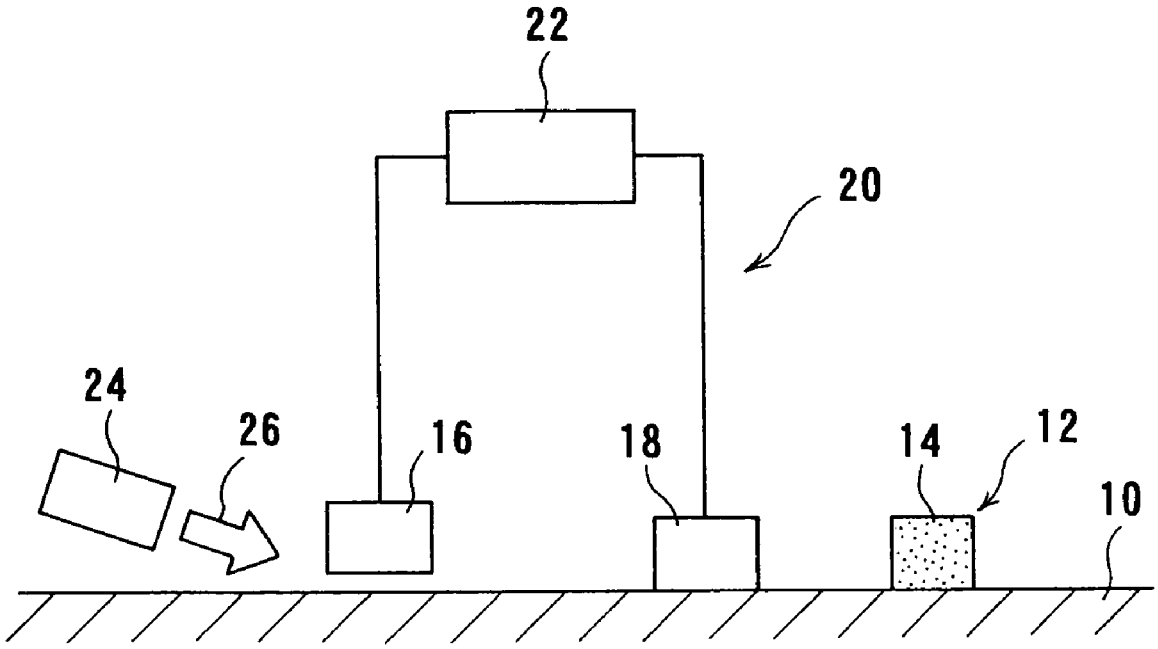
FIG. 2 is a diagram illustrating a basic processing system in which a fixed-abrasive processing section comprising a fixed abrasive, and an electrolytic processing section comprising a processing electrode and a feeding electrode are disposed on a surface of a workpiece to carry out processing of the surface.
Figure 3A:
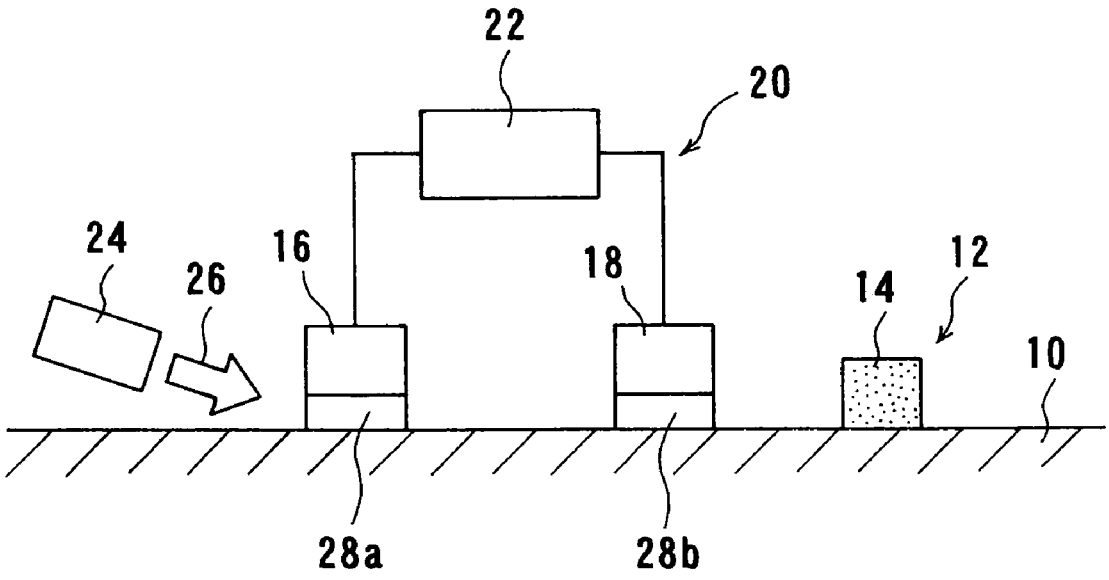
FIG. 3A is a diagram illustrating a basic processing system having the same construction as the system illustrated inv FIG. 2, except that an ion exchanger is mounted on the processing electrode and the feeding electrode of the electrolytic processing section.
Figure 3B:
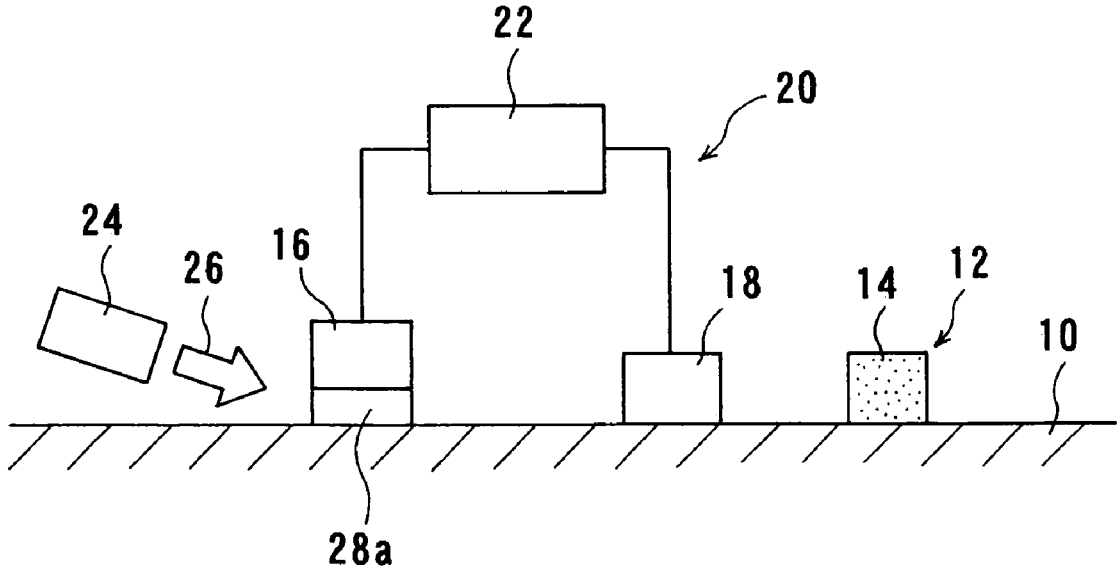
FIG. 3B is a diagram illustrating a basic processing system having the same construction as the system illustrated in FIG. 3A, except that the ion exchanger is only mounted on the processing electrode.
Figure 4:
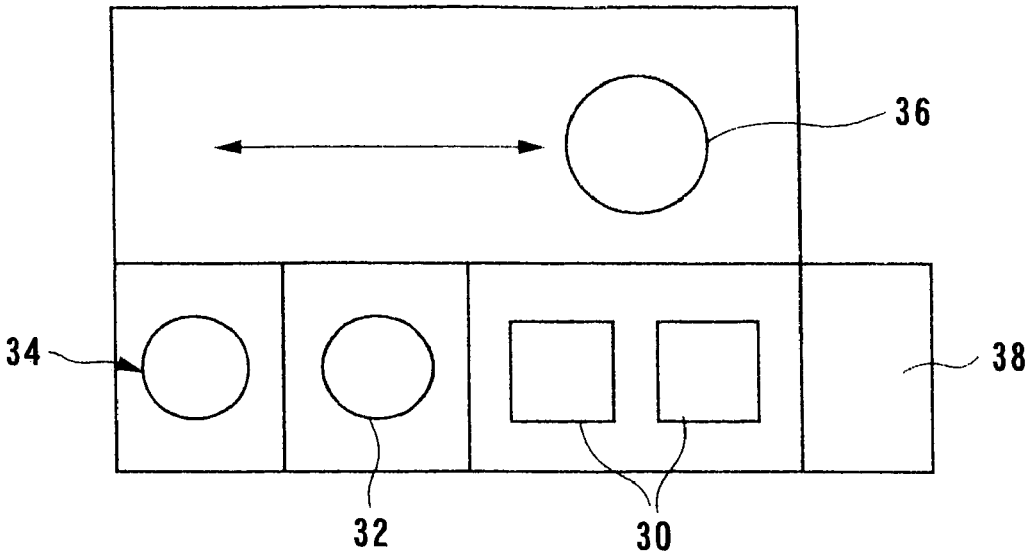
FIG. 4 is a layout plan view of a substrate processing apparatus incorporating a composite processing apparatus according to an embodiment of the present invention.

FIG. 4 is a plan view showing the construction of a substrate processing apparatus incorporating a composite processing apparatus according to a first embodiment of the present invention. As shown in FIG. 4, the substrate processing apparatus comprises a pair of loading/unloading sections 30 as a carry-in and carry-out section for carrying in and carrying out a cassette housing a substrate, e.g. a substrate W having a copper film 6 as a conductive film (portion to be processed) in the surface as shown in FIG. 1B; a reversing machine 32 for reversing the substrate W; and a composite processing apparatus 34. These devices are disposed in series. A transport robot 36 as a transport device, which can move parallel to these devices for transporting and transferring the substrate W therebetween, is provided. The substrate processing apparatus is also provided with a monitor section 38, disposed adjacent to the loading/unloading sections 30, for monitoring a voltage applied between the processing electrodes and the feeding electrodes during electrolytic processing in the composite processing apparatus 34, or an electric current flowing therebetween.

Figure 5:
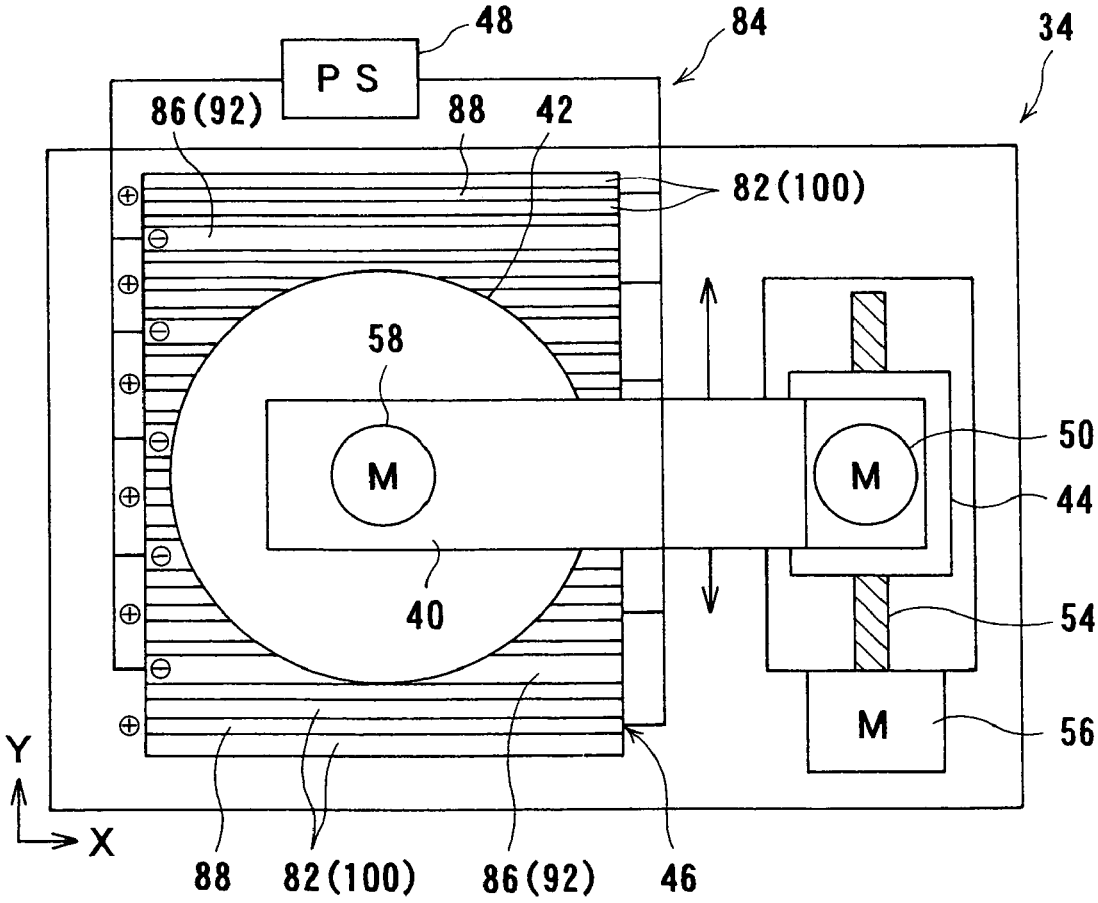
FIG. 5 is a plan view schematically showing the composite processing apparatus of the substrate processing apparatus shown in FIG. 4.
Figure 6:
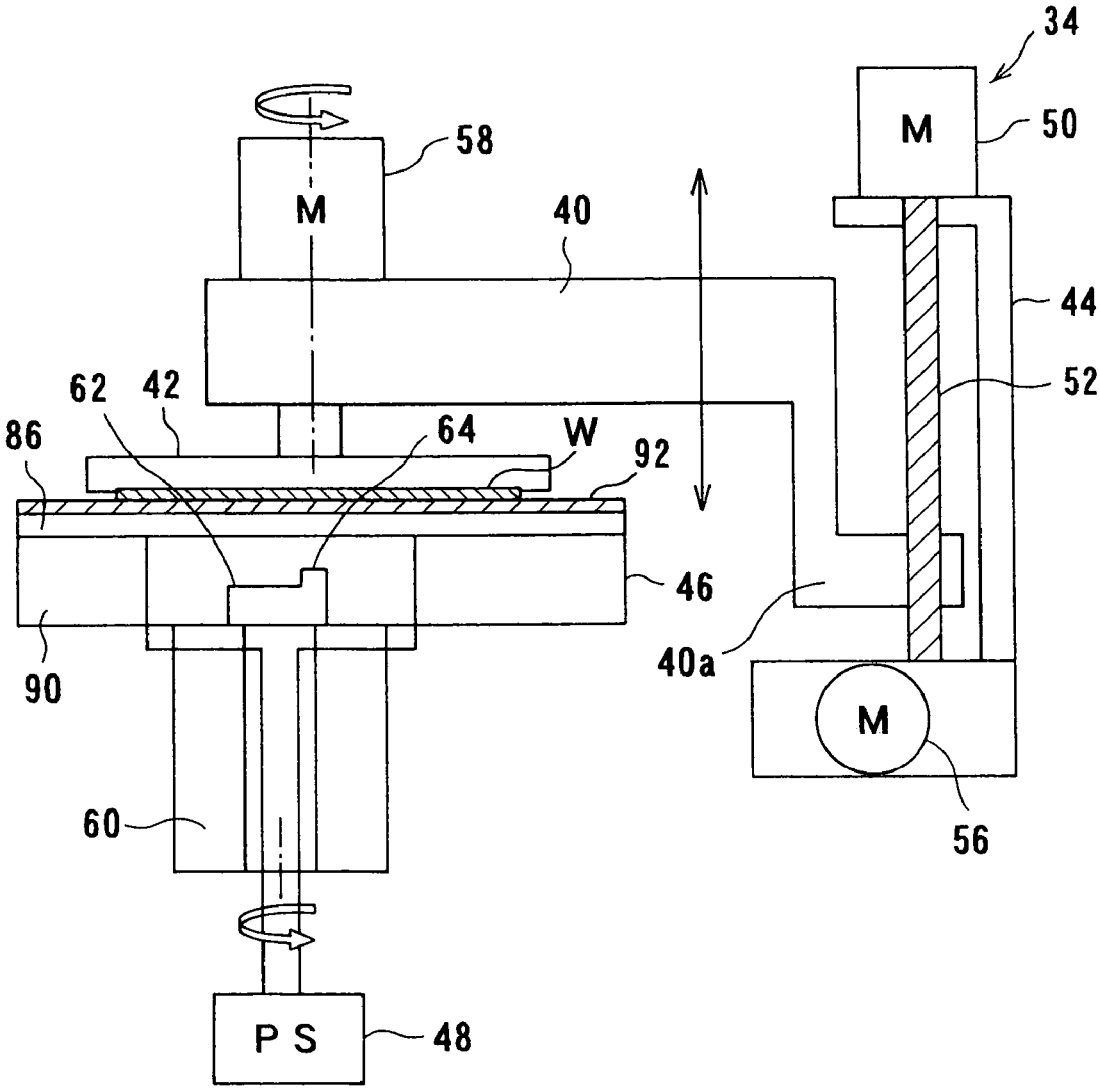
FIG. 6 is a vertical sectional view of FIG. 5.

FIG. 5 is a plan view schematically showing the composite processing apparatus according to an embodiment of the present invention, and FIG. 6 is a vertical sectional view of FIG. 5. As shown in FIGS. 5 and 6, the composite processing apparatus 34 of this embodiment includes an arm 40 that can move vertically and make a reciprocation movement in a horizontal plane, a substrate holder 42, supported at the free end of the arm 40, for attracting and holding the substrate W with its front surface (surface to be processed) facing downward (face down), a moveable frame 44 to which the arm 40 is attached, a rectangular processing table 46, and a power source 48 to be electrically connected to the processing electrodes 86 and feeding electrodes 88 provided on the processing table 46. In this embodiment, the processing table 46 is designed to have a slightly larger diameter than that of the substrate W to be held by the substrate holder 42.

A vertical-movement motor 50 is mounted on the upper end of the moveable frame 44. A ball screw 52, which extends vertically, is connected to the vertical-movement motor 50. The base 40*a* of the arm 40 is engaged with the ball screw 52, and the arm 40 moves up and down via the ball screw 52 by the actuation of the vertical-movement motor 50. The moveable frame 44 is connected to a ball screw 54 that extends horizontally, and the moveable frame 44 and the arm 40 move back-and-forth in a horizontal plane by the actuation of a reciprocating motor 56.

The substrate holder 42 is connected to a rotating motor 58 supported at the free end of the arm 40. The substrate holder 42 is rotated (about its own axis) by the actuation of the rotating motor 58. The arm 40 can move vertically and make a reciprocation movement in the horizontal direction, as described above, and the substrate holder 42 can move vertically and make a reciprocation movement in the horizontal direction integrated with the arm 40.

A hollow motor 60 is disposed below the processing table 46. A drive end 64 is provided on a main shaft 62 of the hollow motor 60 and arranged eccentrically position with respect to the center of the main shaft 62. The processing table 46 is rotatably connected, via a bearing (not shown), to the drive end 64 at its central portion. Three or more of rotation-prevention mechanisms are provided in the circumferential direction between the processing table 46 and the hollow motor 60. Accordingly, the processing table 46 is allowed to make a scroll movement (translational movement) by the actuation of the hollow motor 64.

Figure 7A:
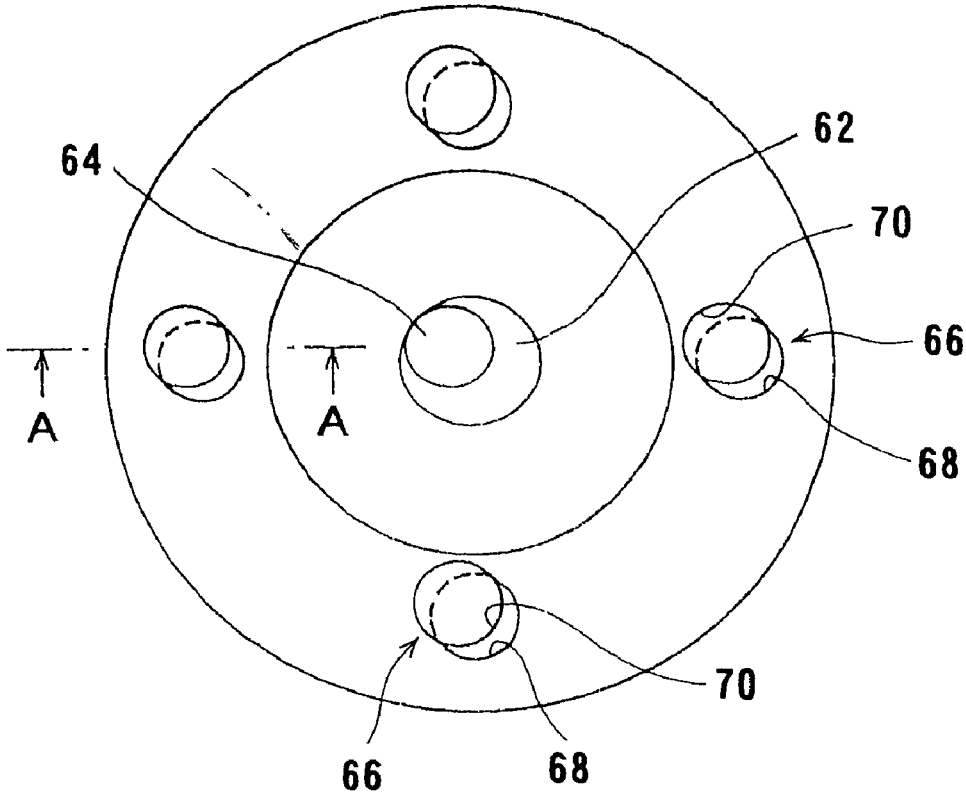
FIG. 7A is a plan view showing the rotation-preventing mechanisms of the composite processing apparatus shown in FIG. 5.
Figure 7B:
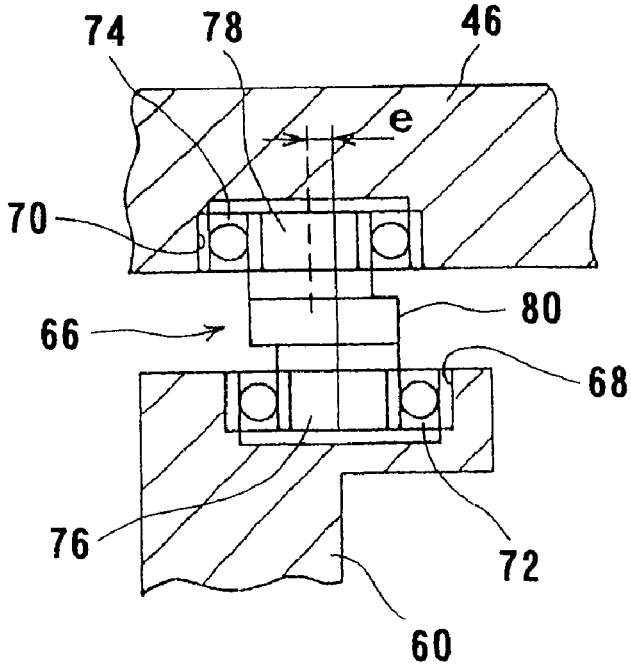
FIG. 7B is a cross-sectional view taken along line A-A of FIG. 7A.

FIG. 7A is a plan view of the rotation-prevention mechanisms of this embodiment, and FIG. 7B is a cross-sectional view taken alone line A-A of FIG. 7A. As shown in FIGS. 7A and 7B, three or more (four in FIG. 7A) of the rotation-prevention mechanisms 66 are provided in the circumferential direction between the processing table 46 and the hollow motor 60. As shown in FIG. 7*a*, a plurality of depressions 68, 70 are formed at equal intervals in the circumferential direction at corresponding positions in the upper surface of the hollow motor 60 and in the lower surface of the processing table 46. Bearings 72, 74 are fixed in each depression 68, 70 respectively. A connecting member 80, which has two shafts 76, 78 that are eccentric to each other by eccentricity "e", is coupled to each pair of the bearings 72, 74 by inserting the respective ends of the shafts 76, 78 into the bearings 72, 74. Further, the eccentricity of the drive end 64 to the main shaft 62 of the hollow motor 60 is also "e". Accordingly, the processing table 46 makes a revolutionary movement with the distance "e" between the center of the main shaft 62 and the drive end 64 as radius, without rotation about its own axis, i.e. the so-called scroll movement (translational rotation) by the actuation of the hollow motor 60.

Figure 8:
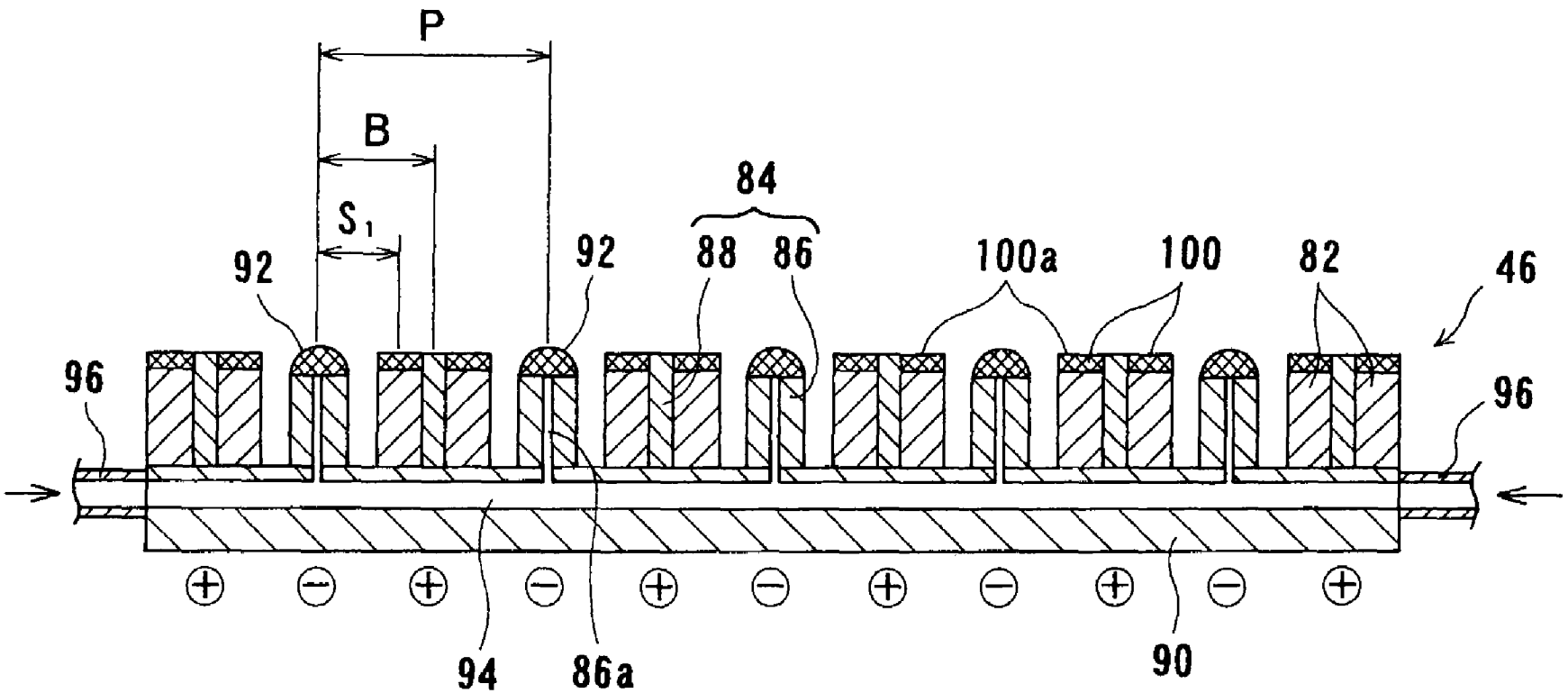
FIG. 8 is an enlarged view of the main portion of the composite processing apparatus shown in FIG. 5.

A description will now be given of the processing table 46 of this embodiment. As shown in FIG. 5, the processing table 46 of this embodiment has a plurality of mechanical processing sections 82, and a plurality of processing electrodes 86 and feeding electrodes 88, constituting electrolytic processing sections 84. FIG. 8 is a vertical sectional view of the processing table 46. As shown in FIG. 8, the processing table 46 includes a tabular base 90. The processing electrodes 86 and feeding electrodes 88, both extending in the X direction (see FIG. 5), are arranged alternately at regular intervals on the upper surface of the base 90. On either side of each feeding electrode 88 are disposed mechanical processing sections 82 extending in the X direction (see FIG. 5). The upper surface of each processing electrode 86 is covered with an ion exchanger 92 having a semicircular cross-section.

According to this embodiment, the above-described rotational radius "e" of scroll movement of the processing table 46 is set to be equal to the distance B between each processing electrode 86 and its adjacent feeding electrode 88, and longer than the distance $S_1$ between each processing electrode 86 and its adjacent mechanical processing section 82 ($B=e>S_1$). This allows a mechanical processing section 82 to pass a portion of a substrate after a processing electrode 86 has passed that portion.

Consider now one processing electrode 86 in electrolytic processing of a substrate W. The processing proceeds only in that portion of the substrate W which is close to or in contact with the ion exchanger 92 on the processing electrode 86. Further, the electric field concentrates at the end portions in the width direction of the processing electrode 86. Accordingly, the processing rate is high around the end portions in the width direction of the processing electrode 86 compared to the central portion.

The processing amount thus varies with respect to one processing electrode 86. According to this embodiment, as described above, the processing table 46 is allowed to make a scroll movement so that the substrate W and the processing electrodes 86 make a relative reciprocating movement in the Y direction (see FIG. 5), thereby reducing the variation in the processing amount. Though the variation in the processing amount can be reduced by the scroll movement, it cannot be completely eliminated.

According to this embodiment, in addition to the above-described scroll movement (first relative movement), the substrate holder 42 is moved in the Y direction (see FIG. 5) for a predetermined distance during electrolytic processing to allow the substrate W and the processing electrodes 86 to make a second relative movement, thereby eliminating the above-described variation in the processing amount. It is noted in this regard that when only the scroll movement (first relative movement) is carried out in electrolytic processing, a variation in the processing amount of the substrate W is produced in the Y direction, and the same processing amount distribution profile appears at every pitch P (see FIG. 8) of the processing electrodes 86. According to this embodiment, during electrolytic processing, the reciprocating motor 56 is actuated to move the arm 40 and the substrate holder 42 in the Y direction for a distance corresponding to an integral multiple of the pitch P, thereby carrying out the second relative movement between the substrate W and the processing electrodes 86. By thus carrying out the second relative movement together with the first relative movement, it becomes possible to process the entire surface of the substrate W uniformly. It is preferred that the speed of the second relative movement be constant.

It is possible to repeat the second relative movement so that the substrate W reciprocates relative to the processing electrodes 86 in the Y direction. In this case, though the moving distance of the forward movement and that of the backward movement both should correspond to an integral multiple of the above-described pitch P, the two moving distances may not necessarily be made equal. For example, the moving distance of the forward movement may be twice the pitch P, and that of the backward movement may be equal to the pitch P.

The above-described ion exchanger 92 may be composed of a non-woven fabric that has an anion-exchange group or a cation-exchange group. A cation exchanger preferably carries a strongly acidic cation-exchange group (sulfonic acid group); however, a cation exchanger carrying a weakly acidic cation-exchange group (carboxyl group) may also be used. Though an anion exchanger preferably carries a strongly basic anion-exchange group (quaternary ammonium group), an anion exchanger carrying a weakly basic anion-exchange group (tertiary or lower amino group) may also be used. The base material of the ion exchangers 92 may be a polyolefin such as polyethylene or polypropylene, or any other organic polymer. Further, besides the form of a non-woven fabric, the ion exchangers may be in the form of a woven fabric, a sheet, a porous material, or short fibers, etc. A non-woven ion exchanger may be disposed inside the ion exchanger 92 to enhance the elasticity.

The non-woven fabric carrying a strongly basic anion-exchange group can be prepared by, for example, the following method. A polyolefin non-woven fabric having a fiber diameter of 20-50 μm and a porosity of about 90% is subjected to the so-called radiation graft polymerization, comprising γ-ray irradiation onto the non-woven fabric and the subsequent graft polymerization, thereby introducing graft chains; and the graft chains thus introduced are then aminated to introduce quaternary ammonium groups thereinto. The capacity of the ion-exchange groups introduced can be determined by the amount of the graft chains introduced. The graft polymerization may be conducted by the use of a monomer such as acrylic acid, styrene, glicidyl methacrylate, sodium styrenesulfonate or chloromethylstyrene, or the like. The amount of the graft chains can be controlled by adjusting the monomer concentration, the reaction temperature and the reaction time. Thus, the degree of grafting, i.e. the ratio of the weight of the non-woven fabric after graft polymerization to the weight of the non-woven fabric before graft polymerization, can be made 500% at its maximum. Consequently, the capacity of the ion-exchange groups introduced after graft polymerization can be made 5 meq/g at its maximum.

The non-woven fabric carrying a strongly acidic cation-exchange group can be prepared by the following method. As in the case of the non-woven fabric carrying a strongly basic anion-exchange group, a polyolefin non-woven fabric having a fiber diameter of 20-50 μm and a porosity of about 90% is subjected to the so-called radiation graft polymerization comprising γ-ray irradiation onto the non-woven fabric and the subsequent graft polymerization, thereby introducing graft chains; and the graft chains thus introduced are then treated with a heated sulfuric acid to introduce sulfonic acid groups thereinto. If the graft chains are treated with a heated phosphoric acid, phosphate groups can be introduced. The degree of grafting can reach 500% at its maximum, and the capacity of the ion-exchange groups thus introduced after graft polymerization can reach 5 meq/g at its maximum.

The base material of the ion exchanger 92 may be a polyolefin such as polyethylene or polypropylene, or any other organic polymer. Further, besides the form of a non-woven fabric, the ion exchanger may be in the form of a woven fabric, a sheet, a porous material, or short fibers, etc. When polyethylene or polypropylene is used as the base material, graft polymerization can be effected by first irradiating radioactive rays (γ-rays and electron beam) onto the base material (pre-irradiation) to thereby generate a radical, and then reacting the radical with a monomer, whereby uniform graft chains with few impurities can be obtained. When an organic polymer other than polyolefin is used as the base material, on the other hand, radical polymerization can be effected by impregnating the base material with a monomer and irradiating radioactive rays (γ-rays, electron beam and UV-rays) onto the base material (simultaneous irradiation). Though this method fails to provide uniform graft chains, it is applicable to a wide variety of base materials.

By using a non-woven fabric having an anion-exchange group or a cation-exchange group as the ion exchanger 92, it becomes possible that pure water or ultrapure water, or a liquid such as an electrolytic solution can freely move within the non-woven fabric and easily arrive at the active points in the non-woven fabric having a catalytic activity for water dissociation, so that many water molecules are dissociated into hydrogen ions and hydroxide ions. Further, by the movement of pure water or ultrapure water, or a liquid such as an electrolytic solution, the hydroxide ions produced by the water dissociation can be efficiently carried to the surfaces of the processing electrodes 86, whereby a high electric current can be obtained even with a low voltage applied.

According to this embodiment, the processing electrodes 86 are connected to the cathode of a power source 48 and the feeding electrodes 88 are connected to the anode of the power source 48. This applies to processing of e.g. copper, because electrolytic processing of copper proceeds on the cathode side. Depending upon the material to be processed, the feeding electrode may be connected to the cathode of the power source, and the processing electrode may be connected to the anode. Thus, when the material to be processed is copper, molybdenum, iron, or the like, the electrolytic processing action occurs on the cathode side, and therefore the electrode connected to the cathode of the power source becomes a processing electrode, and the electrode connected to the anode becomes a feeding electrode. On the other hand, when the material to be processed is aluminum, silicon, or the like, the electrolytic processing action occurs on the anode side, and therefore the electrode connected to the anode of the power source becomes a processing electrode and the electrode connected to the cathode becomes a feeding electrode.

By thus providing the processing electrodes 86 and the feeding electrodes 88 alternately in the Y direction (see FIG. 5) of the processing table 46, provision of a feeding section for feeding electricity to the conductive film (portion to be processed) of the substrate W is no longer necessary, and processing of the entire surface of the substrate W becomes possible. Further, by changing the positive and negative of the voltage applied between the processing electrodes 86 and the feeding electrodes 88 in a pulse form, it becomes possible to dissolve the electrolysis products, and improve the flatness of the processed surface through the multiplicity of repetition of processing.

With respect to the processing electrodes 86 and the feeding electrodes 88, oxidation or dissolution thereof due to an electrolytic reaction may be a problem. In view of this, as a material for the electrodes, it is possible to use, besides the conventional metals and metal compounds, carbon, relatively inactive noble metals, conductive oxides or conductive ceramics, preferably. A noble metal-based electrode may, for example, be one obtained by plating or coating platinum or iridium onto a titanium electrode, and then sintering the coated electrode at a high temperature to stabilize and strengthen the electrode. Ceramics products are generally obtained by heat-treating inorganic raw materials, and ceramics products having various properties are produced from various raw materials including oxides, carbides and nitrides of metals and nonmetals. Among them there are ceramics having an electric conductivity. When an electrode is oxidized, the value of the electric resistance generally increases to cause an increase of applied voltage. However, by protecting the surface of an electrode with a non-oxidative material such as platinum or with a conductive oxide such as an iridium oxide, the decrease of electric conductivity due to oxidation of the base material of an electrode can be prevented.

As shown in FIG. 8, a passage 94, for supplying a processing liquid, such as pure water, preferably ultrapure water, to the surface (surface to be processed) of the substrate W is provided in the interior of the base 90 of the processing table 46. The passage 94 is connected, via a pure water supply tube 96, to a pure water supply source (not shown). Through-holes 86*a*, which are communicated with the passage 94, are provided in the processing electrodes 88. Pure water, preferably ultrapure water (processing liquid) is supplied to the interior of the ion exchangers 92 via the through-holes 86*a*.

"Pure water" herein refers to a water having an electric conductivity of not more than 10 μS/cm, for example. "Ultrapure" water refers to a water having an electric conductivity of not more than 0.1 μS/cm, for example. The use of pure water or ultrapure water containing no electrolyte upon electrolytic processing can prevent extra impurities such as an electrolyte from adhering to and remaining on the surface of the substrate W. Further, copper ions or the like dissolved during electrolytic processing are immediately caught by the ion exchangers 92 through the ion-exchange reaction. This can prevent the dissolved copper ions or the like from re-precipitating on the other portions of the substrate W, or from being oxidized to become fine particles which contaminate the surface of the substrate W.

It is possible to use, instead of pure water or ultrapure water, a liquid having an electric conductivity of not more than 500 μS/cm or an electrolytic solution obtained by adding an electrolyte to pure water or ultrapure water. Further, it is also possible to use, instead of pure water or ultrapure water, a liquid obtained by adding a surfactant to pure water or ultrapure water, and having an electric conductivity of not more than 500 μS/cm, preferably not more than 50 μS/cm, more preferably not more than 0.1 μS/cm (resistivity of not less than 10 MΩ-cm).

On the other hand, a fixed-abrasive plate 100 composed of a fixed abrasive, in this embodiment, is provided in the upper surface of each mechanical processing section 82 so that the surface of the fixed-abrasive plate 100 constitutes a processing surface (polishing surface) 100*a*. The fixed abrasive is prepared by dispersing abrasive grains, such as ceria or silica, in a binder such as a thermosetting resin, e.g. an epoxy resin, a thermoplastic resin, or a core-shell type resin, e.g. MBS or ABC; and molding the mixture into a plate. The ratio between abrasive grains, binder and pores in the fixed abrasive is, for example, abrasive grains:binder:pores=10-50%:30-80%:0-40% (extremes included). The fixed abrasive may also be one prepared by fixing a thin layer of a binder containing abrasive grains on a flexible sheet.

Such a fixed-abrasive plate 100 provides a hard processing surface 100*a* with which a stable processing rate can be obtained while preventing the formation of scratches. Further, the use of pure water not containing abrasive grains or a liquid prepared by adding an additive, such as a surfactant to pure water in carrying out processing (chemical mechanical polishing) enable to reduce the usage of a polishing liquid which is costly and requires troublesome handling.

Figure 9:
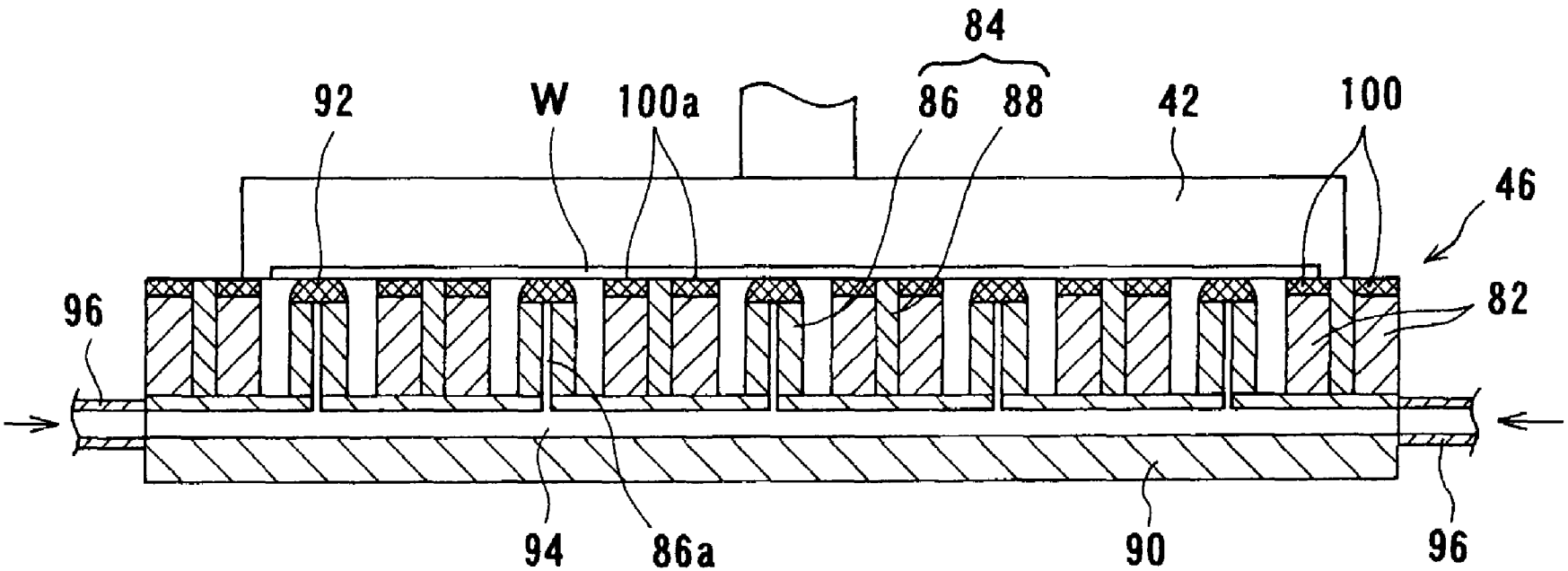
FIG. 9 is an enlarged view of the main portion of the composite processing apparatus shown in FIG. 5 during processing.

It is ideal that all the ion exchangers 92, the feeding electrodes 88 and the processing surfaces 100*a* of the fixed-abrasive plates 100, facing a substrate W, contact the substrate W uniformly during processing. In view of this, the upper surfaces of the feeding electrodes 88 and the processing surfaces 100*a* of the fixed-abrasive plates 100 are set on the same level, and slightly lower than the level of the tops of the ion exchangers 92. Accordingly, as shown in FIG. 9, when pressing the substrate W against the ion exchangers 92, the substrate W securely contacts the upper surfaces of the feeding electrodes 88 and the processing surfaces 100*a* of the fixed-abrasive plates 100. Further, if the substrate W is further pressed, the pressing force is received by the feeding electrodes 88 and the fixed-abrasive plates 100. Accordingly, there is no change in the contact area between the substrate W and the ion exchangers 92. Thus, according to this embodiment, the substrate W can be prevented from tilting and the contact areas between the substrate W and the ion exchangers 92 can be made uniform. This enables a uniform processing.

A description will now be given of processing of a substrate using the substrate processing apparatus. First, a cassette housing substrates W, having a surface copper film 6 as a conductive film (portion to be processed) as shown in FIG. 1B, is set in the loading/unloading section 30, and one substrate W is taken by the transport robot 36 out of the cassette. The transport robot 36 transports the substrate W to the reversing machine 32, if necessary, where the substrate W is reversed so that the front surface with the conductive film (copper film 6) formed faces downward.

The transport robot 36 receives the reversed substrate W and transports it to the composite processing apparatus 34 where the substrate W is attracted and held by the substrate holder 42. The arm 40 is then pivoted to move the substrate holder 42 holding the substrate W to a processing position right above the processing table 46. Next, the vertical-movement motor 50 is actuated to lower the substrate holder 42 so as to bring the substrate W, held by the substrate holder 42, into contact with the surfaces of the ion exchangers 92 of the processing table 46. The substrate holder 42 is further lowered so that the substrate W, while collapsing the upper portions of the ion exchangers 92, comes into contact with the upper surfaces of the feeding electrodes 88 and the processing surfaces 100*a* of the fixed-abrasive plates 100.

Next, while rotating the substrate W by the actuation of the rotating motor 58, the processing table 46 is allowed to make a scroll movement by the actuation of the hollow motor 60 and, at the same time, the substrate W is reciprocated by the actuation of the reciprocating motor 56. On the other hand, pure water or ultrapure water is supplied through the through-holes 86*a* of each processing electrode 86 to the ion exchanger 92, thereby impregnating the ion exchanger 92 with pure water or ultrapure water and filling the space between the substrate W held by the substrate holder 42 and the processing table 46 with pure water or ultrapure water. The pure water or ultrapure water is discharged from the ends of the base 90 to the outside.

A given voltage is applied from the power source 48 to between the processing electrodes 86 and the feeding electrodes 88 to carry out electrolytic processing of the surface conductive film (copper film 6) of the substrate W at the processing electrodes (cathodes) 86 by the action of hydrogen ions or hydroxide ions generated by the ion exchangers 92. Though processing progresses in those portions of the substrate W which face the processing electrodes 86, the entire surface of the substrate W can be processed by moving the substrate W and the processing electrodes 86 relative to each other. Simultaneously with the electrolytic processing, the surface of the substrate W is rubbed with the processing surfaces 100*a* of the fixed-abrasive plates 100 of the mechanical processing sections 82 in the presence of pure water or ultrapure water to carry out mechanical processing of the surface conduction film (copper film 6) of the substrate W with the fixed abrasive.

In the case of electrolytic processing (polishing) of a copper film using an ion exchanger and electrodes (a processing electrode and a feeding electrode), copper is considered to be directly taken in the ion exchanger. In some cases, however, a passive film of e.g. $Cu_2O$ or CuO is formed in a surface of a copper film during electrolytic processing. Such a passive film is physically soft and is non-conductive, and therefore cannot be removed only by electrolytic processing. Further, pits (small holes) can be formed in the processed surface. According to the composite electrolytic apparatus of this embodiment, a passive film, if formed, can be removed by the mechanical processing sections 82 using the fixed abrasive, and subsequently the processed surface can be re-processed by the electrolytic processing sections 84. This enables a low-surface pressure, high-rate processing and provides a flatter processed surface. Further, the mechanical processing sections 82 can remove not only a passive film, but also gas bubbles, adhering to the substrate W, which would cause the formation of pits.

Figure 10A:
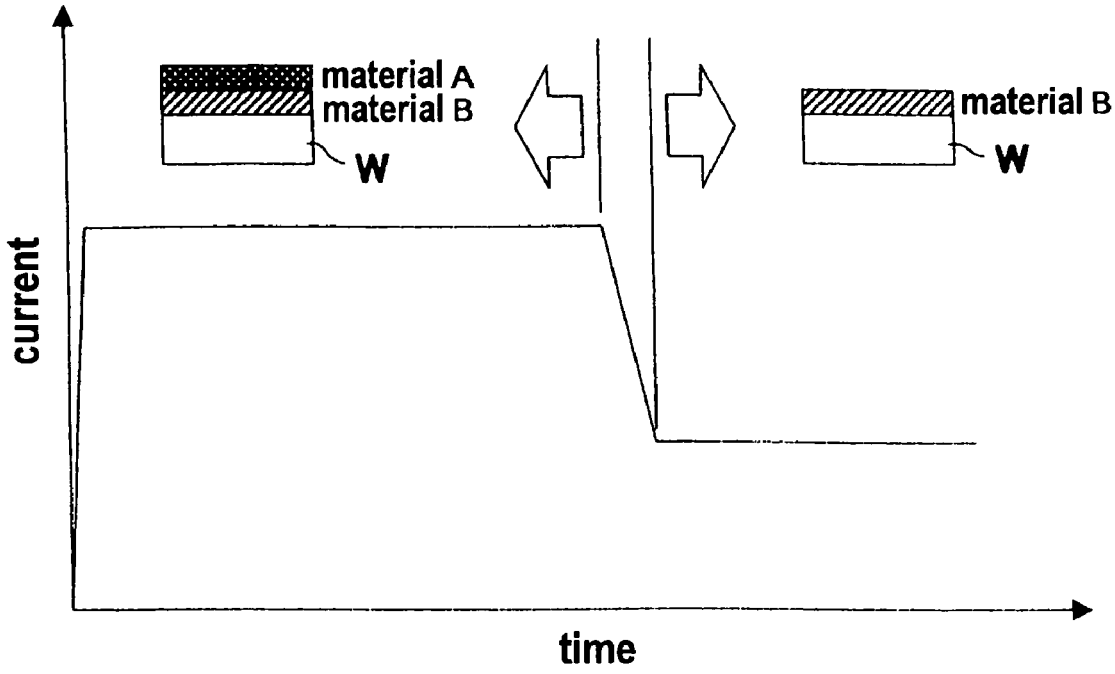
FIG. 10A is a graph showing the relationship between the electric current and time, as observed in the electrolytic processing of a surface of a substrate having a surface film composed of two different materials.
Figure 10B:
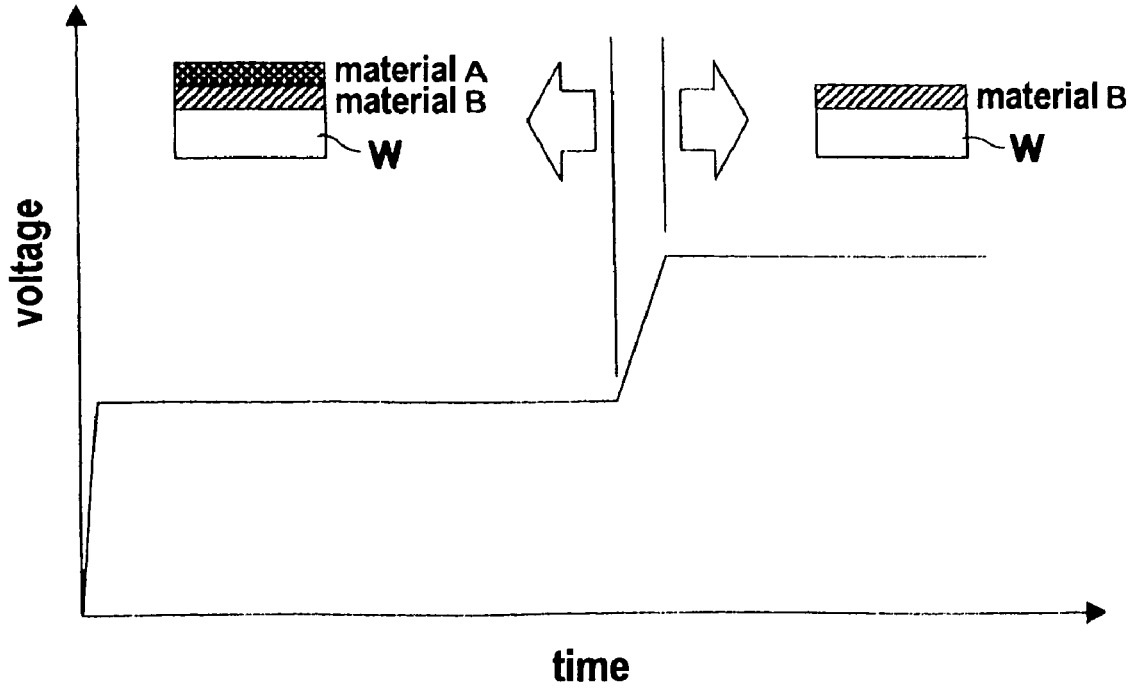
FIG. 10B is a graph showing the relationship between the voltage applied and time, as observed in the electrolytic processing of the surface of the substrate having the surface film composed of two different materials.

During electrolytic processing, the monitor section 38 monitors the voltage applied between the processing electrodes 86 and the feeding electrodes 88 or the electric current flowing therebetween to detect the end point (terminal of processing). It is noted in this connection that in electrolytic processing an electric current (applied voltage) varies, depending upon the material to be processed, even with the same voltage (electric current) For example, as shown in FIG. 10A, when an electric current is monitored in electrolytic processing of a surface of a substrate W to which a film of material B and a film of material A are laminated in this order, a constant electric current is observed during the processing of material A, but it changes upon the shift to the processing of the different material B. Likewise, when a voltage applied between the processing electrodes 86 and the feeding electrodes 88 is monitored, as shown in FIG. 10B, though a constant voltage is applied between the processing electrodes 86 and the feeding electrodes 88 during the processing of material A, the voltage applied changes upon the shift to the processing of the different material B. FIG. 10A illustrates, by way of example, a case in which an electric current is harder to flow in electrolytic processing of material B compared to electrolytic processing of material A, and FIG. 10B illustrates a case in which the applied voltage becomes higher in electrolytic processing of material B compared to electrolytic processing of material A. As will be appreciated from the above-described example, the monitoring of changes in electric current or in voltage can surely detect the end point.

Though this embodiment shows the case where the monitor section 38 monitors the voltage applied between the processing electrodes 86 and the feeding electrodes 88, or the electric current flowing therebetween to detect the end point of processing, it is also possible to allow the monitor section 38 to monitor a change in the state of the substrate being processed to detect an arbitrarily set end point of processing. In this case, the end point of processing refers to a point at which a desired processing amount is attained for a specified region in a surface to be processed, or a point at which an amount corresponding to a desired processing amount is attained in terms of a parameter correlated with a processing amount for a specified region in a surface to be processed. By thus arbitrarily setting and detecting the end point of processing even in the middle of processing, it becomes possible to conduct a multi-step electrolytic processing.

For example, the processing amount may be determined by detecting a change in frictional force due to a difference in friction coefficient produced when a different material is reached in a substrate, or a change in frictional force produced by removal of irregularities in the surface of the substrate. The end point of processing may be detected based on the processing amount thus determined. During electrolytic processing, heat is generated by the electric resistance of the surface to be processed, or by collision between water molecules and ions moving in the liquid (pure water) between the surface to be processed and the processing surface. In processing e.g. a copper film deposited on the surface of a substrate under a controlled constant voltage, when a barrier layer or an insulating film becomes exposed with the progress of electrolytic processing, the electric resistance increases and the current value decreases, and the heat value decreases. Accordingly, the processing amount may be determined by detecting the change in the heat value. The end point of processing may therefore be detected. Alternatively, the film thickness of a film to be processed on a substrate may be determined by detecting a change in the intensity of reflected light due to a difference in reflectance produced when a different material is reached in the substrate. The end point of processing may be detected based on the film thickness thus determined. The film thickness of a film to be processed on a substrate may also be determined by generating an eddy current within a conductive film, for example, a copper film, and monitoring the eddy current flowing within the substrate to detect a change in e.g. the frequency, thereby detecting the end point of processing. Further, in electrolytic processing, the processing rate depends on the value of the electric current flowing between the processing electrode and the feeding electrode, and the processing amount is proportional to the quantity of electricity, determined by the product of the current value and the processing time. Accordingly, the processing amount may be determined by integrating the quantity of electricity, and detecting the integrated value reaching a predetermined value. The end point of processing may thus be detected.

After completion of the electrolytic processing, the power source 48 is disconnected from the processing electrodes 86 and the feeding electrodes 88. The rotation and the reciprocating movement of the substrate holder 42, and the scroll movement of the processing table 46 are stopped. Thereafter, the substrate holder 42 is raised, and the substrate W is transferred to the transport robot 36 after moving the arm 40. The transport robot 36 takes the substrate W from the substrate holder 42 and, if necessary, transfers the substrate W to the reversing machine 32 for reversing it, and then transfers the substrate W to the cassette in the loading/unloading section 30.

The ion exchanger 92 should preferably have good water permeability. By allowing pure water or ultrapure water to pass through the ion exchangers 92, it becomes possible to supply a sufficient amount of water to functional groups (e.g. sulfonic acid groups in a strongly acidic cation exchanger) which promote the dissociation reaction of water, thereby increasing the amount of dissociated products. Furthermore, processing products (including gas) produced by a reaction between the portion to be processed and hydroxide ions (or OH radicals) can be removed by the flow of water, thereby increasing the processing efficiency. A water-permeable sponge-like member or a member in the form of a membrane, such as Nafion (trademark, DuPont Co.), having through-holes for permitting water to flow therethrough, is used as such a water-permeable member.

The use of a fixed abrasive containing abrasive grains therein in the mechanical processing section 82 makes it possible to carry out mechanical polishing with the mechanical processing section 82 and electrolytic processing with the electrolytic processing section 84 by solely supplying pure water, i.e. not supplying a slurry containing abrasive grains, and obtain both the benefits of electrolytic processing and the benefits of mechanical processing by the fixed abrasive. The use of pure water can facilitate post-processing, such as cleaning, of a substrate as well as treatment of the waste liquid. Further, the fixed-abrasive plate 100 is unlikely to deform elastically. Accordingly, it is possible to contact the fixed-abrasive plate 100 only with raised portions of a substrate having a fine pattern of surface irregularities to selectively remove the raised portions.

Further, by providing the electrolytic processing section 84 and the mechanical processing section 82 separately, it is possible to selectively use contact members for a substrate, such as an ion exchanger, a fixed abrasive and the below-described polishing pad, which are particularly or selectively suited for the electrolytic processing section 84 or for the mechanical processing section 82. Furthermore, it is possible to change the proportion between the electrolytic processing section 84 and the mechanical processing section 82 in the entire processing surface of the processing table so as to change the proportion between electrolytic processing and mechanical processing for a substrate. The apparatus construction can thus be optimized for obtaining the best flattened processed surface.

Figure 11:
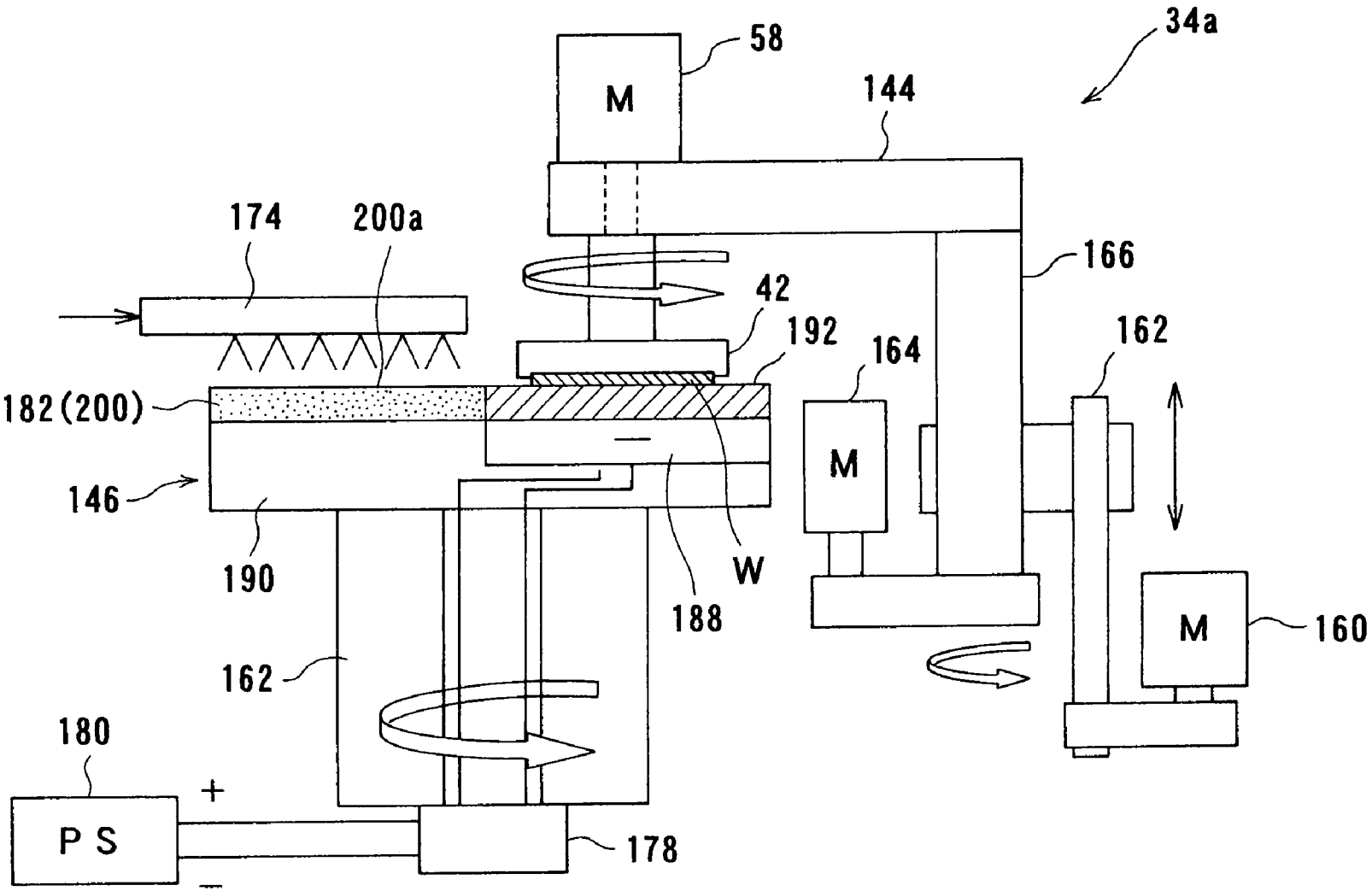
FIG. 11 is a cross-sectional diagram schematically showing a composite processing apparatus according to another embodiment of the present invention.
Figure 12:
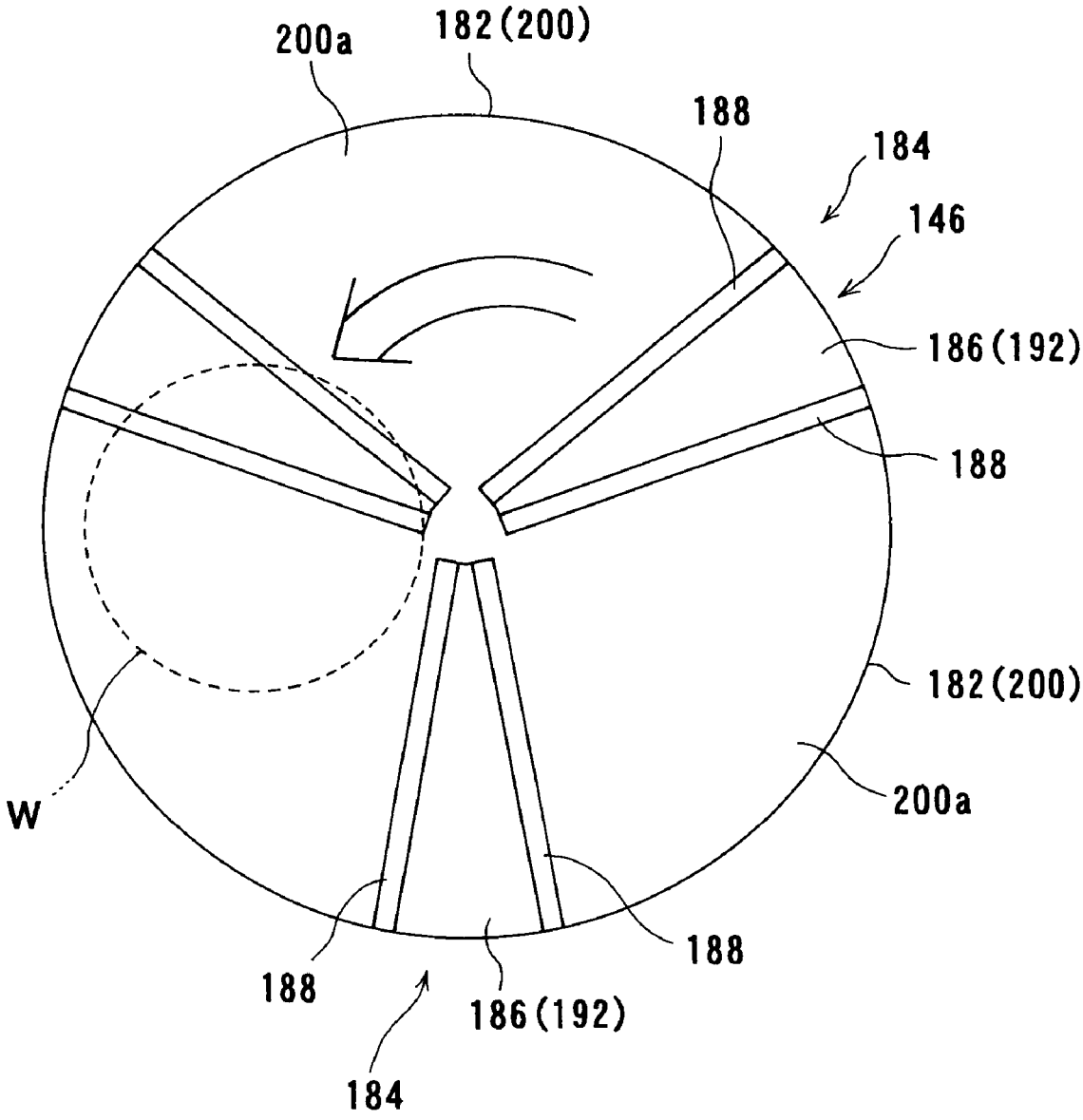
FIG. 12 is a plan view of a processing table of the composite processing apparatus shown in FIG. 11.

FIG. 11 shows a vertical sectional view of a composite processing apparatus according to another embodiment of the present invention, and FIG. 12 shows a plan view of the processing table of the composite processing apparatus shown in FIG. 11. The composite processing apparatus 34*a* of this embodiment differs from the composite processing apparatus 34 of the preceding embodiment in the following respects.

The composite processing apparatus 34*a* of this embodiment includes a processing table 146 which has a diameter more than twice the diameter of a substrate W to be held by the substrate holder 42, and which rotates (about its own axis) by the actuation of a hollow motor 162. Further, above the processing table 146 is provided an abrasive liquid nozzle 174 as a slurry supply section for supplying a slurry (abrasive liquid) onto the upper surface of the processing table 146.

The processing table 146 includes a disk-shaped base 190. On the upper surface of the base 190 are provided mechanical processing sections 182, and processing electrodes 186 and feeding electrodes 188 which constitute the electrolytic processing sections 184. The processing electrodes 186 are to be connected, via a slip ring 178, to the cathode of a power source 180, and the feeding electrodes 188 are to be connected to the anode. An upper surface of each processing electrode 186 is covered with an ion exchanger 192. Though in this embodiment a strip-shaped feeding electrode 188 having a uniform width in the radial direction is employed, it is also possible to use a fan-shaped one.

As shown in FIG. 12, the processing electrode 186, covered with the ion exchanger 192, has the shape of a fan extending in the radial direction of the base 190, and a plurality of processing electrodes 186 (3 electrodes are shown) are arranged at a predetermined pitch along the circumferential direction. Two feeding electrodes 188 are disposed on both sides of one processing electrode 186. According to this embodiment, the mechanical processing sections 182, each of which is comprised of a polishing pad 200 with the upper surface as a processing surface 200*a*, are provided in the entire region, except the processing electrodes 186 and the feeding electrodes 188, of the upper surface of the base 190.

The area of the processing electrodes 186 is set smaller than the area of the mechanical processing sections 182. By sandwiching each processing electrode 186 between two feeding electrodes 188, the feeding electrodes 188 can surely contact the surface of a substrate W and feed electricity thereto when the ion exchanger 192 of the processing electrode 186 contacts the substrate W. According to this embodiment, the processing electrodes 188 are to perform processing to passivate the surface of a substrate without performing removal processing, such as polishing, of the substrate surface.

Commercially available polishing pads (polishing cloths) 200, such as SUBA 800, IC-1000, etc., manufactured by Rodel, Inc., can be used The substrate holder 42, which is to hold a substrate W and which rotates by the actuation of the rotating motor 58, is held at the free end of a pivot arm 144. The pivot arm 144 moves vertically via a ball screw 162 by the actuation of a vertical-movement motor 160, and is coupled to the upper end of a pivot shaft 166 that rotates by the actuation of a pivoting motor 164.

According to this embodiment, a substrate W, as shown in FIG. 11, having a surface copper film 6 as a conductive film (portion to be processed), is attracted and held by the substrate holder 42 of the composite processing apparatus 34*a*, and the pivot arm 144 is pivoted to move the substrate holder 42 to a processing position right above the processing table 146. Next, the vertical-movement motor 160 is actuated to lower the substrate holder 42 so as to bring the substrate W held by the substrate holder 42 into contact with the ion exchangers 192, the feeding electrodes 188 and the processing surfaces 200*a* of the polishing pads 200 of the processing table 146.

The processing electrodes 186 and the feeding electrodes 188 are connected to the power source 180 to apply a given voltage between the processing electrodes 186 and the feeding electrodes 188. While rotating the substrate holder 42 and the processing table 146, a slurry (abrasive liquid) is supplied from the abrasive liquid nozzle 174 onto the upper surface of the processing table 146 to fill the space between the processing table 146 and the substrate W held by the substrate holder 42 with the slurry; thereby carrying out, in the presence of the slurry, processing to form a passive film in the surface of the conductive film (copper film 6) of the substrate in contact with the ion exchangers 192 covering the processing electrodes 186, and mechanical polishing with the polishing pads 200 to mechanically polish away the passive film while feeding electricity from the feeding electrodes 188 to the conductive film. The processing of re-forming a passive film in the surface of the conductive film of the substrate and polishing away the passive film is carried out repeatedly. Thus, by selectively forming a passive film only in the raised portions of a surface conductive film of a substrate having a fine pattern of surface irregularities and selectively removing the passive film, the raised portions of the substrate (conductive film) can be removed selectively.

After the completion of electrolytic processing, the power source 180 is disconnected, the rotations of the substrate holder 42 and the processing table 146 are stopped, and the supply of the slurry is stopped. Thereafter, the substrate holder 42 is raised, and the pivot arm 144 is pivoted to send the substrate W to the next process step.

It is possible in this embodiment to provide a tub surrounding the processing table in order to carry out processing of a substrate while immersing the electrodes and the substrate in a processing liquid (pure water) supplied from the processing electrodes.

The present invention is not limited to ultrapure water electrolytic processing using an ion exchanger. In the case of electrolytic processing using an electrolytic solution, in FIGS. 6 through 9, a liquid-permeable scrubbing member, such as a sponge or SUBA (trademark of Rodel, Inc.), may be provided on each electrode, and an insulating member may be interposed between adjacent electrodes in order to prevent passage of electricity.

Further, instead of providing the feeding electrodes on the processing table side to feed electricity to a substrate as in the above-described embodiments, it is also possible to feed electricity from the substrate holder to the bevel portion of a substrate. In that case, the processing electrodes may not be provided in the processing table, or all the electrodes on the processing table side may be made processing electrodes (cathodes).

As described above, according to the present invention, a physically soft and non-conductive passive film, which is formed in a surface of a substrate during processing by the electrolytic processing section, can be removed by the mechanical processing section, and subsequently the processed surface can be re-processed by the electrolytic processing section. This enables a low-surface pressure, high-rate processing. Further, by mechanically processing the substrate surface with the mechanical processing section, gas bubbles adhering to the substrate surface can also be removed together with the passive film. This can securely prevent the formation of pits in the processed surface.

Figure 13:
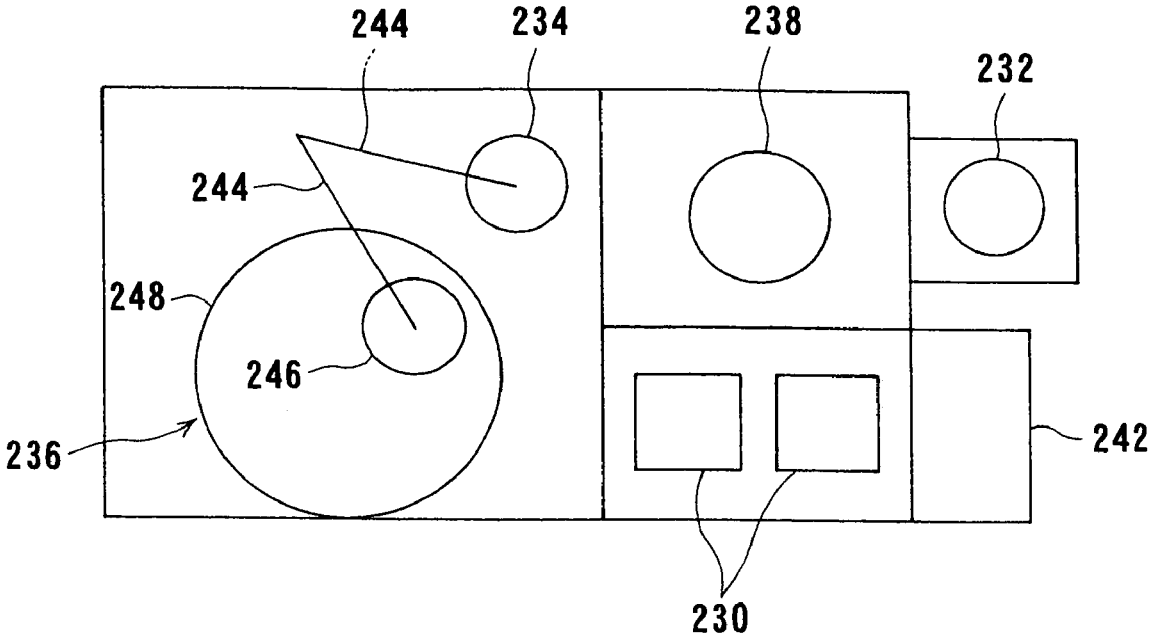
FIG. 13 is a layout plan view of a substrate processing apparatus incorporating a composite processing apparatus according to yet another embodiment of the present invention.

FIG. 13 is a layout plan view of a substrate processing apparatus incorporating a composite processing apparatus according to yet another embodiment of the present invention. As shown in FIG. 13, the substrate processing apparatus comprises a pair of loading/unloading sections 230 as a carry-in-and-out section for carrying in and out a cassette housing, for example, substrates W having a surface copper film 6 as a conductive film (portion to be processed) as shown in FIG. 1B; a reversing machine 232 for reversing the substrate W; a pusher 234 for transferring the substrate W; and a composite processing apparatus 236. The composite processing apparatus 236 includes a substrate holder 246 for holding the substrate W, and a processing table 248 having the below-described electrolytic processing sections and fixed-abrasive processing sections. Located at a position surrounded by the loading/unloading sections 230, the reversing machine 232 and the pusher 234, a fixed-type transport robot 238 is provided as a transport device for transporting and receiving the substrate W to and from them. Further, as with the above-described substrate processing apparatus, a monitor section 242 is provided for monitoring a voltage applied between processing electrodes and feeding electrodes, or an electric current flowing therebetween during electrolytic processing by the composite processing apparatus 236.

Figure 14:
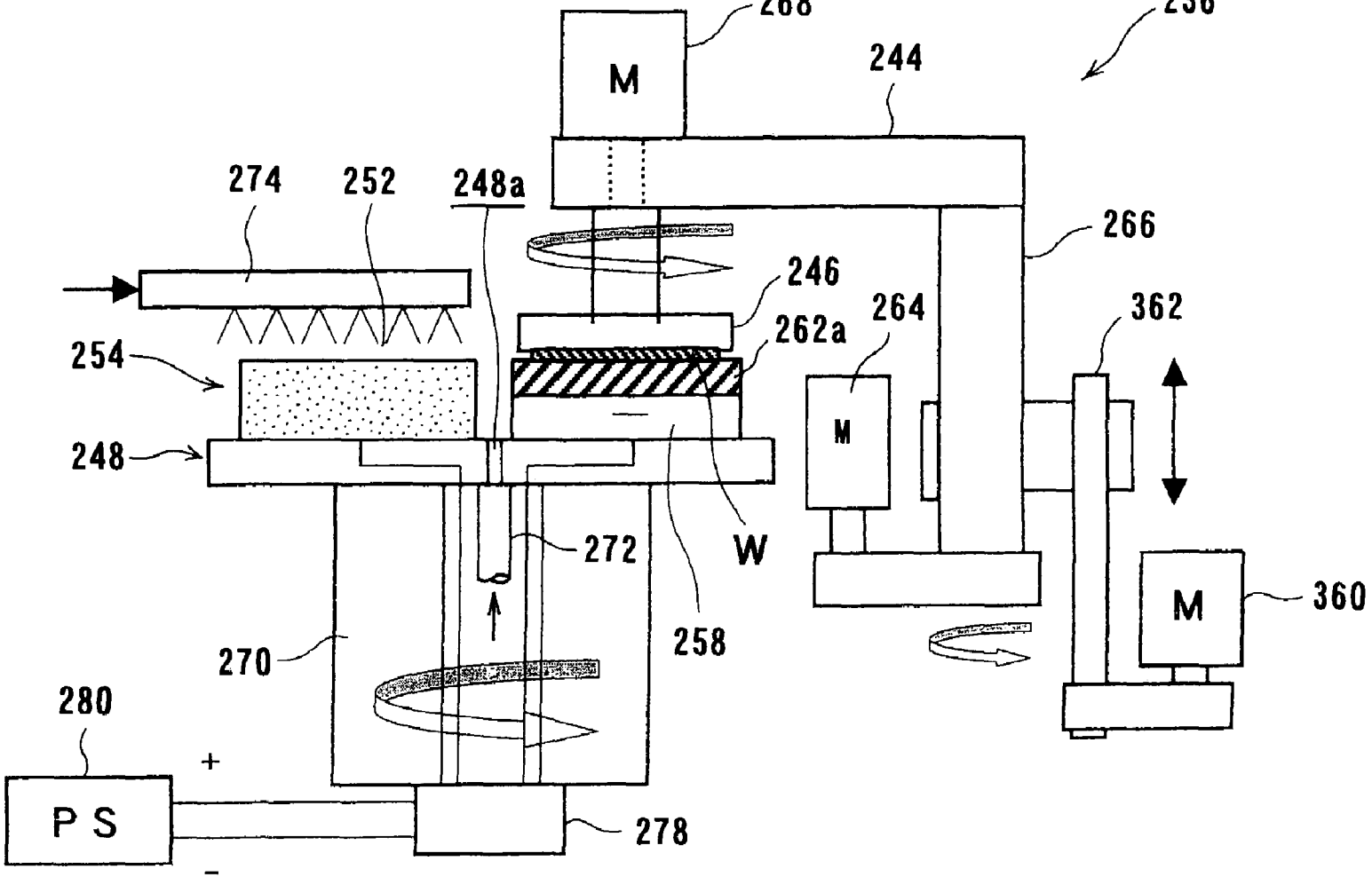
FIG. 14 is a plan view schematically showing the composite processing apparatus of the substrate processing apparatus shown in FIG. 13.
Figure 15:
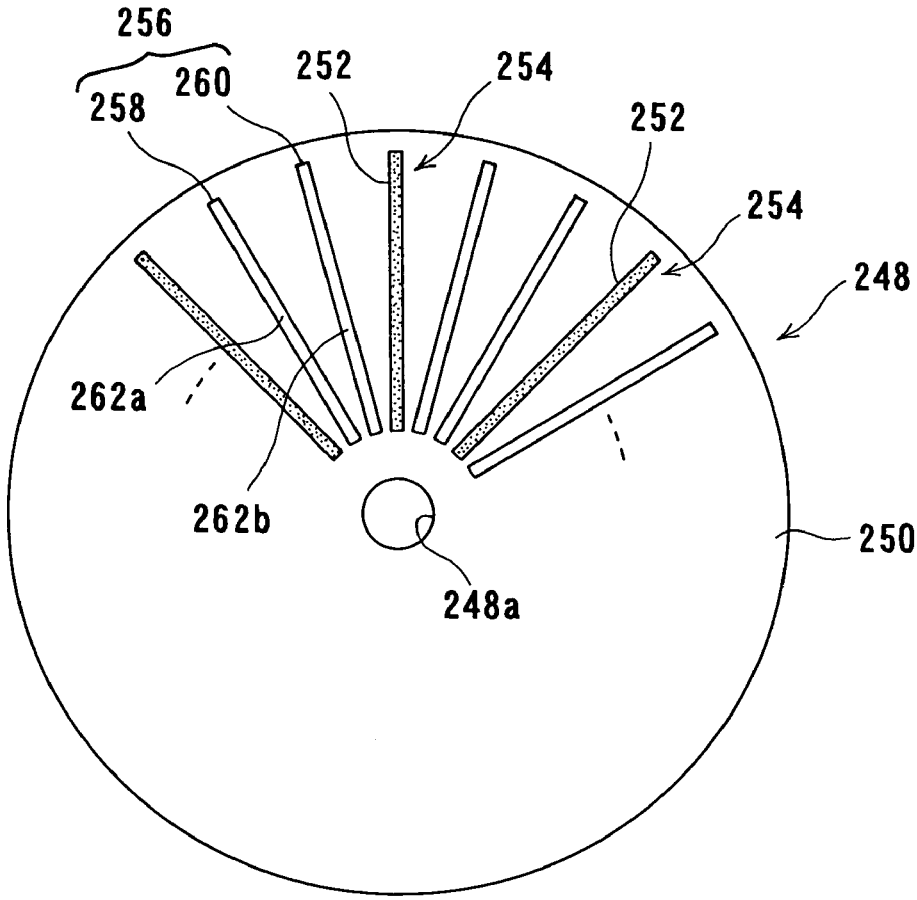
FIG. 15 is a plan view of a processing table of the composite processing apparatus shown in FIG. 14.
Figure 16:
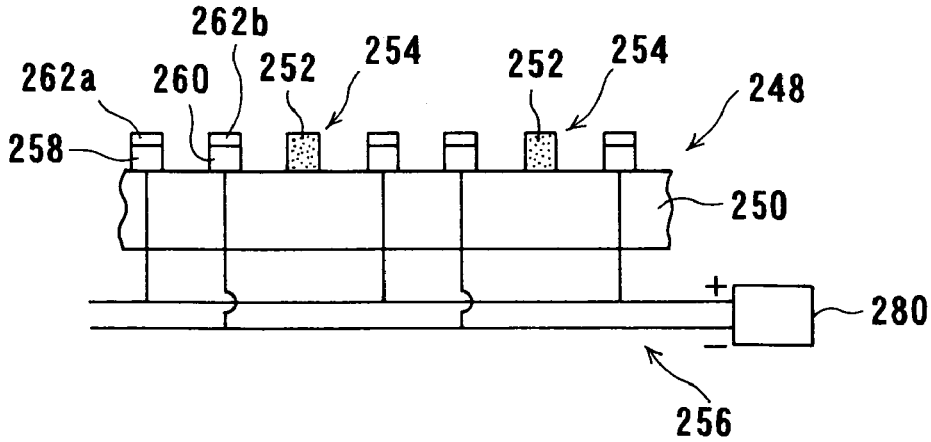
FIG. 16 is a cross-sectional view along the circumferential direction of FIG. 15.

As shown in FIG. 14, the composite processing apparatus 236 includes a substrate holder 246, suspended from the free end of a horizontally-pivotable pivot arm 244, for attracting and holding a substrate W face down; and a disk-shaped processing table 248 including a base 250 formed of an insulating material. As shown in FIGS. 15 and 16, a plurality of fixed-abrasive processing sections 254 comprising a fixed abrasive 252 containing abrasive grains, and a plurality of processing electrodes 258 and feeding electrodes 260, constituting electrolytic processing sections 256, are arranged radially and alternately along the circumferential direction on the upper surface of the base 250.

According to this embodiment, an ion exchanger 262*a* is mounted on the substrate holder 246 side surface (upper surface) of each processing electrode 258, and an ion exchanger 262*b* is mounted on the substrate holder 246 side surface (upper surface) of each feeding electrode 246. By thus mounting the ion exchangers 262*a*, 262*b* on the processing electrodes 258 and the feeding electrodes 260, it becomes possible to use pure water, preferably ultrapure water as a processing fluid and to prevent a short circuit between a processing electrode 258 and a feeding electrode 260, thereby increasing processing efficiency.

It is also possible to mount an ion exchanger on only one of the processing electrodes 258 and the feeding electrodes 260. Further, it is possible not to employ an ion exchanger in the case of using an electrolytic solution as a processing fluid.

The processing table 248 having the fixed-abrasive processing sections 254 and the electrolytic processing sections 256, according to this embodiment, has a diameter more than twice the diameter of the substrate W to be held by the substrate holder 246 so that the entire surface of the substrate W can be mechanically polished and electrolytically processed.

According to this embodiment, the fixed abrasive 252 of each fixed-abrasive processing section 254 has a surface roughness of not more than 10 μm. Further, processing is carried out by pressing surfaces (upper surfaces) of the fixed abrasives 252 and surfaces of the ion exchangers 262*a*, 262*b*, respectively mounted on the processing electrodes 258 and the feeding electrodes 260, against the surface conductive film 6 (see FIG. 1B) as a conductive film of the substrate W held by the substrate holder 246. During processing, a pressure (surface pressure) of not more than 10 psi (69 kPa) is applied between the substrate W and fixed abrasives 252, between the substrate W and the ion exchangers 262*a* mounted on processing electrodes 258, and between the substrate W and the ion exchangers 262*b* mounted on feeding electrodes 260.

Mechanical polishing with the fixed abrasive 252 involves the formation of defects, such as scratches having a depth, pits, etc., in a surface of a workpiece. The defects should desirably be of such a degree as can be removed by electrolytic processing with the electrolytic processing section 256. For example, polishing of a copper surface with a fixed abrasive 252 having a surface roughness of 10 μm, as carried out at a surface pressure of 10 psi, produces scratches having a depth of about 0.3 to 0.5 μm in the copper surface. Polishing of a copper surface at the same surface pressure but using a fixed abrasive 252 having a surface roughness of 5 μm produces scratches having a depth of about 0.2 to 0.3 μm. The depth of scratches that can be removed by electrolytic processing with the electrolytic processing section 256 is around 0.3 μm, preferably less than 0.3 μm. Accordingly, in order to carry out the most uniform mechanical polishing with the fixed abrasive 252 and obtain a cleaner processed surface by electrolytic processing with the electrolytic processing section 256, the grain size of abrasive grains contained in the fixed abrasive 252 is preferably not more that 10 μm.

The processing rate and the processing profile are determined especially by the pressure between the processing electrodes 258 and a workpiece, or the pressure between the fixed abrasives 252 and the workpiece. For a relatively soft metal, such as copper interconnects, or a porous low-k material, it is desirable to apply a low surface pressure so as to suppress the formation of scratches.

The processing according to this embodiment mainly uses electrolytic processing (electrochemical processing), which involves little formation of scratches, and uses mechanical processing with the fixed abrasive 252 as an auxiliary means to provide fine scratches in a surface of a workpiece. Thus, the fixed abrasive 252 is not used for mechanical polishing. By providing fine scratches in the entire surface of a workpiece by mechanical processing with the fixed abrasive 252, a local concentration of electric field in electrolytic processing with the electrolytic processing section 256 can be moderated, thus enabling a uniform, highly-flat processing.

The depth of scratches provided in a workpiece is determined by the surface roughness of the fixed abrasive 252 and the surface pressure. According to this embodiment, as described above, the depth of scratches provided in a copper surface can be made not more than about 0.3 to 0.5 μm by carrying out polishing at a surface pressure of not more than 10 psi using a fixed abrasive 252 having a surface roughness of not more than 10 μm. Scratches having such a depth can be removed by electrolytic processing with the electrolytic processing section 256. Further, the use of a surface pressure of not more than 10 psi for the processing electrodes 258 and the feeding electrodes 260 can respond to the demand for suppressed formation of scratches.

Electrolytic processing may also be carried out by bringing the ion exchangers 262*a*, 262*b*, mounted on the processing electrodes 258 and the feeding electrodes 260, close to the substrate W without contact.

As shown in FIG. 14, the pivot arm 244 is coupled to the upper end of a pivot shaft 266 which moves vertically via a ball screw 362 by the actuation of a vertical-movement motor 360 and rotates by the actuation of a pivoting motor 264. The substrate holder 246 is connected to a rotating motor 268 mounted on the free end of the pivot arm 244, and rotates (about its own axis) by the actuation of the rotating motor 268.

The processing table 248 is connected directly to a hollow motor 270 and rotates (about its own axis) by the actuation of the hollow motor 270. In the center of the base 250 of the processing table 248, a through-hole 248*a* is provided as a liquid supply section for supplying a liquid, such as an electrolytic solution or pure water, preferably ultrapure water. The through-hole 248*a* is connected to a liquid supply pipe 272 extending in the hollow portion of the hollow motor 270. The liquid, such as pure water, preferably ultrapure water, is supplied through the through-hole 248*a* to the ion exchangers 262*a*, 262*b* which are water-absorptive, and then supplied through the ion exchangers 262*a*, 262*b* to the entire processing surface. It is also possible to provide a plurality of through-holes 248*a* connected to the liquid supply pipe 272 so that the processing liquid can easily spread over the entire processing surface.

Located above the processing table 248, a nozzle 274, extending in the radial direction of the processing table 248, is provided as a liquid supply section for supplying a liquid, such as an electrolytic solution or pure water (ultrapure water). Thus, a liquid, such as an electrolytic solution or pure water (ultrapure water), can be supplied from above and below simultaneously to the surface of the substrate W.

According to this embodiment, as shown in FIG. 14, the processing electrodes 258 are to be connected, via a slip ring 278, to the cathode of a power source 280, and the feeding electrodes 260 connected to the anode of the power source 280. By thus providing the processing electrodes 258 and the feeding electrodes 260 alternately along the circumferential direction of the processing table 48, it becomes possible to eliminate a fixed feeding section for feeding electricity to a conductive film (material to be processed) of a substrate, thus enabling processing of the entire surface of the substrate.

A description will now be given of processing (electrolytic processing) of a substrate by the substrate processing apparatus. First, a substrate W as shown in FIG. 1B, having a surface copper film 6 as a conductive film (portion to be processed), is taken by the transport robot 238 out of a cassette housing such substrates W and set in the loading/unloading section 230 and, as necessary, the substrate W is transported to the reversing machine 232 to reverse the substrate W so that its front surface having the conductive film (copper film 6) faces downward. Next, the substrate W with its front surface downward is transported by the transport robot 238 to the pusher 234 and placed on it.

The substrate W placed on the pusher 234 is attracted and held by the substrate holder 42 of the composite processing apparatus 236, and the pivot arm 244 is pivoted to move the substrate holder 246 to a processing position right above the processing table 248. Next, the vertical-movement motor 360 is actuated to lower the substrate holder 246 so as to bring the substrate W held by the substrate holder 246 into pressure contact with the fixed abrasives 252, the ion exchangers 262*a* mounted on the processing electrodes 258 and the ion exchangers 262*b* mounted on the feeding electrodes 260 of the processing table 248. The pressures (surface pressures) of the fixed abrasives 252 and the ion exchangers 262*a*, 262*b* are made not more than 10 psi (69 kpa).

It is also possible to bring one or both of the ion exchangers 262*a*, 262*b* close to the surface of the substrate W.

The processing electrodes 258 and the feeding electrodes 260 are connected to the power source 280 to apply a given voltage between the processing electrodes 258 and the feeding electrodes 260. While rotating the substrate holder 246 and the processing table 248, pure water, preferably ultrapure water is supplied through the through-hole 248*a* to the upper surface of the processing table 248 from below the processing table 248 and, at the same, pure water, preferably ultrapure water is supplied from the nozzle 274 to the upper surface of the processing table 248 from above the processing table 248, thereby filling the space between the processing electrodes 258, the feeding electrodes 260 and the substrate W with pure water, preferably ultrapure water.

By the above operation, the surface conductive film (copper film 6) of the substrate W is mechanically polished upon its contact with the fixed abrasives 292 of the fixed-abrasive processing sections 254 while the surface conductive film (copper film 6), serving as an anode, is electrolytically processed upon its contact with the ion exchangers 262*a* mounted on the processing electrodes 258 connected to the cathode of the power source. By rotating both the substrate holder 246 and the processing table 248, the mechanical polishing and the electrolytic processing can be carried out over the entire surface of the substrate W.

As with the above-described substrate processing apparatus, a voltage applied between the processing electrodes 258 and the feeding electrodes 260, or an electric current flowing therebetween may be monitored with the monitor section 242 to detect the end point of processing.

After the completion of processing, the power source 280 is disconnected from the processing electrodes 258 and the feeding electrodes 260, and the rotations of the substrate holder 246 and the processing table 248 are stopped. Thereafter, the substrate holder 246 is raised and the pivot arm 244 is pivoted to transfer the substrate W to the pusher 234. The transport robot 238 receives the substrate W from the pusher 234 and, as necessary, transports the substrate W to the reversing machine 232 to reverse the substrate W. Thereafter, the transport robot 238 returns the substrate W to the cassette of the loading/unloading section 230.

By thus supplying pure water, preferably ultrapure water between the processing table 248 and the substrate W, impurities such as an electrolyte can be prevented from attaching to and remaining on the surface of the substrate W, and contamination of the surface of the substrate W with dissolved copper ions and the like can be prevented, as in the above-described embodiments.

Though ultrapure water is hard to pass electric current because of its high resistivity, the electric resistance can be reduced by making the distance between an electrode and a workpiece as short as possible or by interposing an ion exchanger between an electrode and a workpiece. The use of an electrolytic solution, instead of ultrapure water, can further lower the electric resistance and reduce the power consumption. In electrolytic processing using an electrolytic solution, a workpiece is processed over a wider area than the workpiece-facing area of a processing electrode. In contrast, in electrolytic processing using ultrapure water and an ion exchanger, because of little passage of electric current in ultrapure water, a workpiece is processed only within the area facing the ion exchanger (processing electrode).

Though this embodiment uses pure water or ultrapure water and the ion exchangers 262*a*, 262*b* mounted on the processing electrodes 258 and the feeding electrodes 260, it is possible to use, instead of pure water or ultrapure water, an electrolytic solution prepared by adding an electrolyte to pure water or ultrapure water, and not to mount any ion exchanger on the processing electrodes 258 and the feeding electrodes 260. The use of an electrolytic solution can lower the electric resistance and reduce the power consumption. Examples of the electrolyte include a neutral salt, such as NaCl or $Na_2SO_4$, an acid, such as HCl or $H_2SO_4$, and an alkali, such as ammonia. A suitable electrolyte may be selected depending on the properties of the workpiece.

Further, as described previously, it is also possible to use, instead of pure water (ultrapure water), a liquid having an electric conductivity of not more than 500 μS/cm, preferably not more than 50 μS/cm, more preferably not more than 0.1 μS/cm (resistivity of not less than 10 MΩ·cm), prepared by adding e.g. a surfactant to pure water (ultrapure water).

Figure 17:
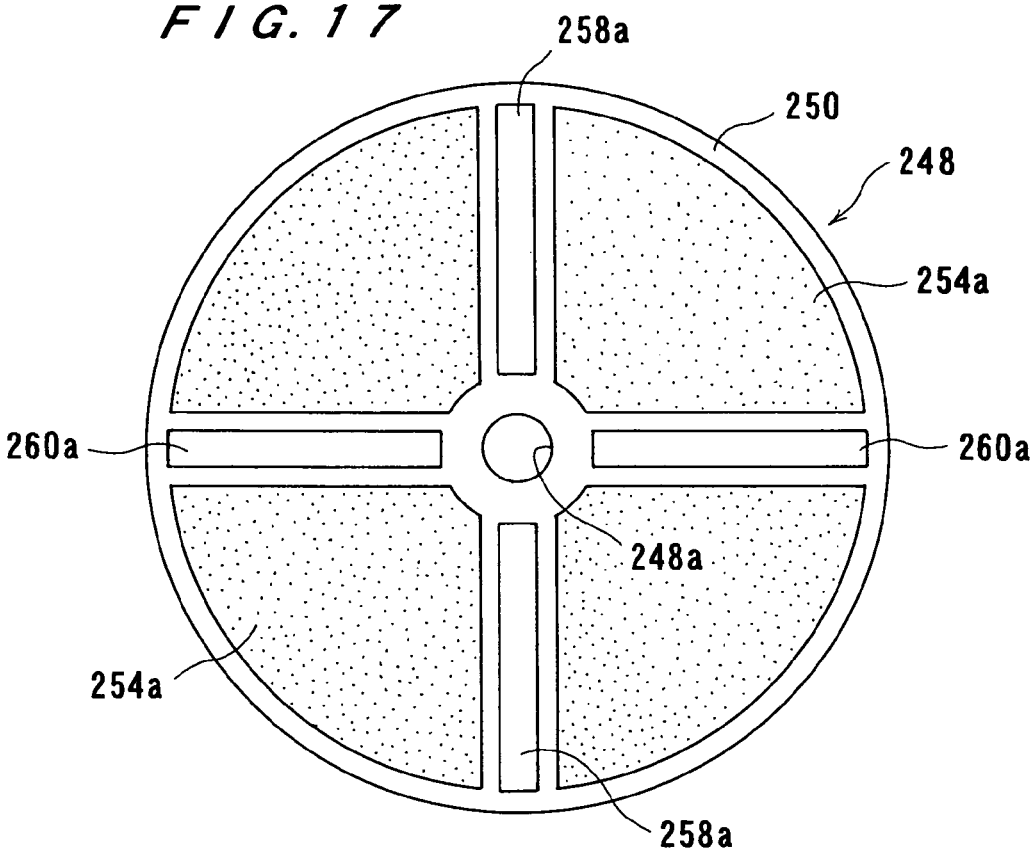
FIG. 17 is a plan view of another processing table.

FIG. 17 shows another processing table 248. The processing table 248 has two linearly-extending processing electrodes 258*a* and two linearly-extending feeding electrodes 260*a*, each processing electrode 258*a* and each feeding electrode 260*a* being at right angles to each other, which are disposed on the base 250 symmetrically with respect to the center of the base 250. Further, a total of four fan-shaped fixed abrasives 252*a* are disposed in the areas between the processing electrodes 258*a* and the feeding electrodes 260*a*. It is, of course, possible to mount an ion exchanger on the processing electrodes 258*a* and the feeding electrodes 260*a*.

Figure 18:
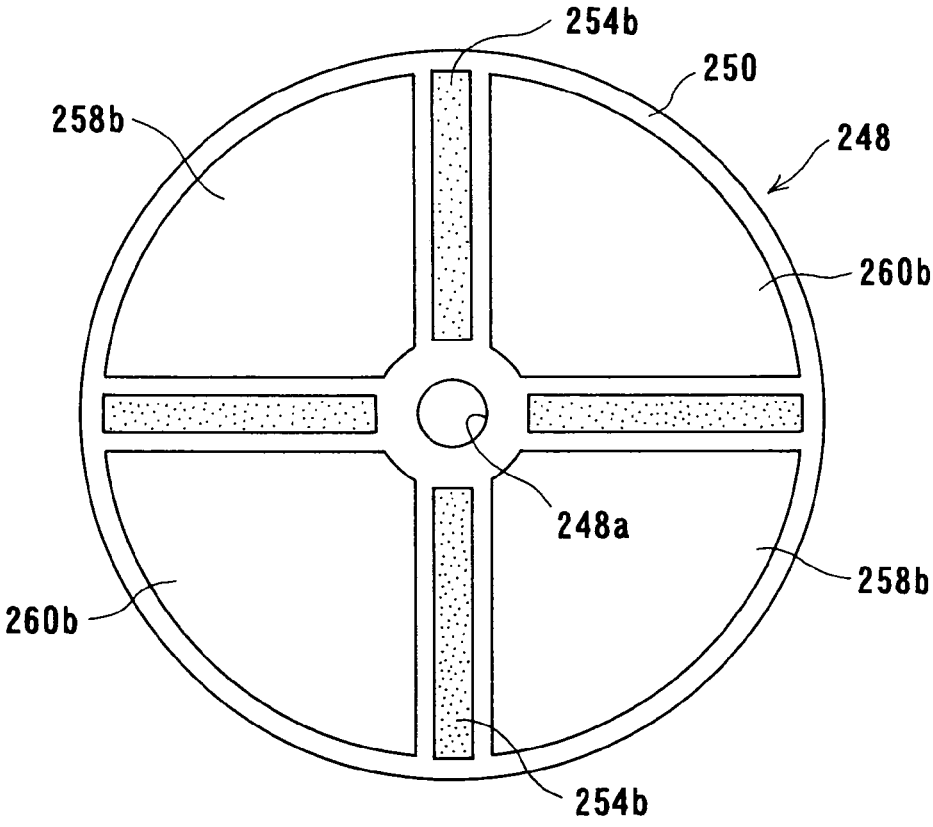
FIG. 18 is a plan view of yet another processing table.

FIG. 18 shows yet another processing table 248. The processing table 248 has four linearly-extending fixed abrasives 254*b* which are disposed on the base 250 symmetrically with respect to the center of the base 250. In the areas between the fixed abrasives 254*b*, two fan-shaped processing electrodes 258*b* and two fan-shaped feeding electrodes 260*b* are disposed alternately along the rotating direction of the processing table 248. It is, of course, possible to mount an ion exchanger on the processing electrodes 258*b* and the feeding electrodes 260*b*.

The shape, number, etc. of the fixed abrasives, constituting the fixed-abrasive processing sections, and of the processing electrodes and the feeding electrodes, constituting the electrolytic processing section, can thus be appropriately selected depending upon the workpiece.

Figure 19:
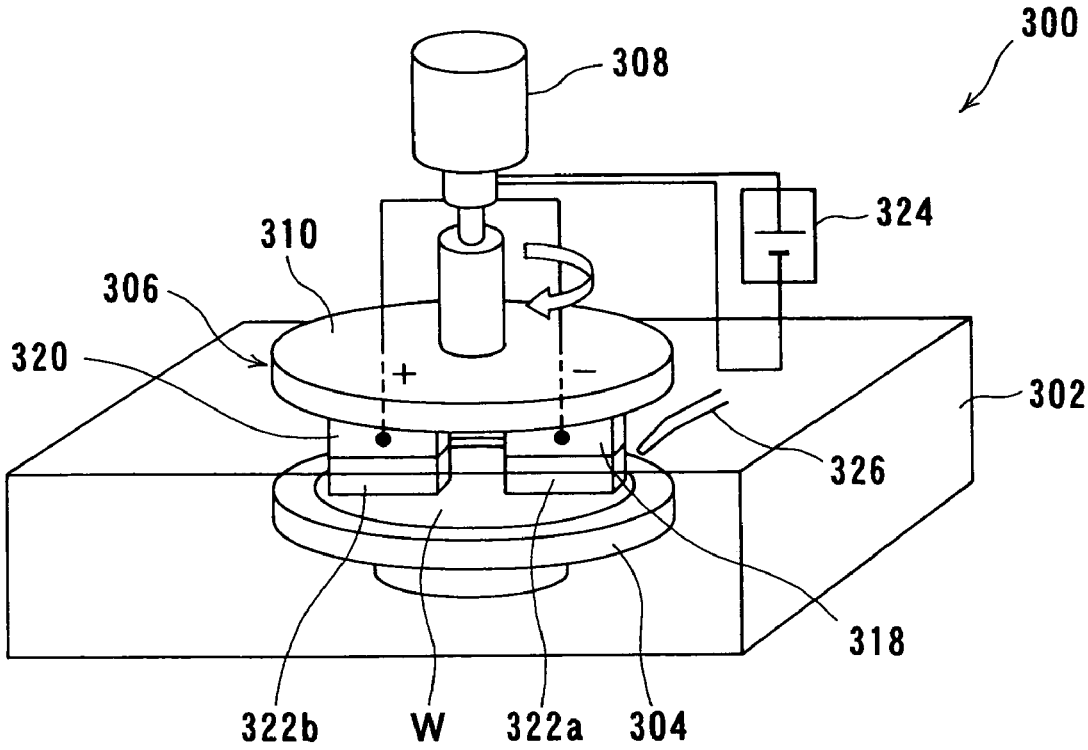
FIG. 19 is a perspective view of a composite processing apparatus according to yet another embodiment of the present invention.
Figure 20:
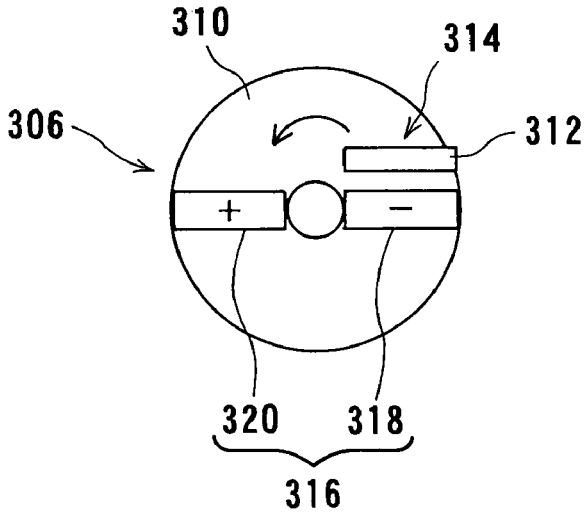
FIG. 20 is a plan view of a processing table of the composite processing apparatus shown in FIG. 19.

FIGS. 19 and 20 show a composite processing apparatus according to yet another embodiment of the present invention. The composite processing apparatus 300 includes a processing chamber 302 for holding a liquid such as pure water, preferably ultrapure water, and preventing scattering of the liquid. In the processing chamber 302, a substrate holder 304, for detachably holding a substrate W with its front surface (surface to be processed) facing upwardly (face up), is disposed such that the substrate W held by the substrate holder 304 becomes immersed in the liquid, such as pure water, supplied into the processing chamber 302.

A processing table 306, which is rotatable by a motor 308 and is vertically movable, is disposed above the substrate holder 304. The processing table 306 includes a base 310 formed of an insulating material. As shown in FIG. 20, a fixed-abrasive processing section 314 composed of a fixed abrasive 312, and a processing electrode 318 and a feeding electrode 320, constituting an electrolytic processing section 316, are detachably mounted to the lower surface of the base 310. A #3000 alumina abrasive sheet having a surface roughness of 4.4 μm or a #8000 diamond abrasive sheet having a surface roughness of 0.5 μm (both manufactured by Sumitomo 3M Ltd.), for example, may be used as the fixed abrasive 312. The processing electrode 318 and the feeding electrode 320 are arranged in a line on the opposite sides of the center of the base 310 with a predetermined spacing, for example, about 3 mm. The fixed abrasive 312 is disposed close to and parallel to the processing electrode 318 on the upstream side of the processing electrode 318 along the rotating direction of the processing table 306.

Ion exchangers 322*a*, 322*b*, each composed of e.g. a two-layer laminate of: an ion exchanger comprising a polyethylene non-woven fabric with a sulfonic acid group introduced by graft polymerization; and a surface sheet-like ion exchanger, Nafion 117 (manufactured by DuPont), are mounted on the substrate holder 304 side surfaces of the processing electrode 318 and the feeding electrode 320. The processing electrode 318 is to be connected to the cathode of a power source 324, and the feeding electrode 320 is to be connected to the anode of the power source 324.

Further, a liquid nozzle 326 for supplying a liquid, such as ultrapure water, to the substrate W held by the substrate holder 304, is disposed in the processing chamber 302.

According to this embodiment, after the substrate W is held by the substrate holder 304, the processing table 306 is lowered so as to press the fixed abrasive 312 and the ion exchangers 322*a*, 322*b*, mounted respectively on the processing electrode 318 and the feeding electrode 320, against the surface of the substrate W at a surface pressure of e.g. 10 psi (69 kPa). While thus pressing on the substrate W and rotating the processing table 306, a liquid, such as ultrapure water, is supplied from the liquid nozzle 326 to the substrate W. During the operation, the processing chamber 302 is filled with the liquid, such as ultrapure water, to prevent scattering of the liquid. The processing electrode 318 is connected to the cathode of the power source 324 and the feeding electrode 320 is connected to the anode of the power source 324, thereby carrying out mechanical processing with the fixed abrasive 312 of the fixed-abrasive processing section 314 and electrolytic processing with the processing electrode 318 of the electrolytic processing section 316 simultaneously in such a manner that immediately after a surface portion of the substrate W is polished by the fixed abrasive 312, the surface portion is electrolytically processed by the processing electrode 318.

It is also possible not to provide a processing chamber, and to allow the liquid, supplied to the surface of a substrate held by the substrate holder, to flow outwardly on the substrate surface to the outside.

As described above, the present invention, by the combination of mechanical polishing processing with a fixed abrasive and electrolytic processing with ultrapure water or an electrolytic solution, can reduce the load on treatment of waste liquid, such as an abrasive slurry or a cleaning liquid, and can considerably enhance the processing properties, such as processing rate and flatness of the processed surface.

Examples 1 and 2

Composite electrolytic processing of a copper plated film was carried out using the composite processing apparatus 300 shown in FIGS. 19 and 20. The processing table 306 of the composite processing apparatus included, on the lower surface of the base 310, the processing electrode 318 and the feeding electrode 320 respectively having, mounted thereon, ion exchangers 322*a*, 322*b* which are composed of a two-layer laminate of: an ion exchanger comprising a polyethylene non-woven fabric with a sulfonic acid group introduced by graft polymerization; and a surface sheet-like ion exchanger, Nafion 117 (manufactured by DuPont) The apparatus also includes a fixed abrasive 312 which is either a #3000 alumina abrasive sheet having a surface roughness of 4.4 μm (Example 1) or a #8000 diamond abrasive sheet having a surface roughness of 0.5 μm (Example 2).

A wafer substrate (50 ϕ) having a thin surface conductive film (copper) was prepared as a test sample. Ultrapure water having a resistivity of not less than 18 MΩ·cm was used as a processing liquid. The ultrapure water was supplied from the liquid nozzle 326 into the processing chamber 302 and held in it, while the sample (substrate W) was attracted and held by the substrate holder 304 and immersed in the ultrapure water to carry out processing of the sample in the following manner.

While rotating the processing table 306 at 200 rpm by the motor 308, the processing electrode 318 and the feeding electrode 320 were connected to a constant-current, constant-voltage power source 324, thereby carrying out electrolytic processing of the copper plated film at a constant current of 0.3 A for 90 seconds. After the processing, the thickness of the remaining film was measured to determine the processing rate. The film thickness was determined by measuring the resistivity using a 4-probe resistivity meter and converting the measured resistivity into a film thickness.

Figure 21:
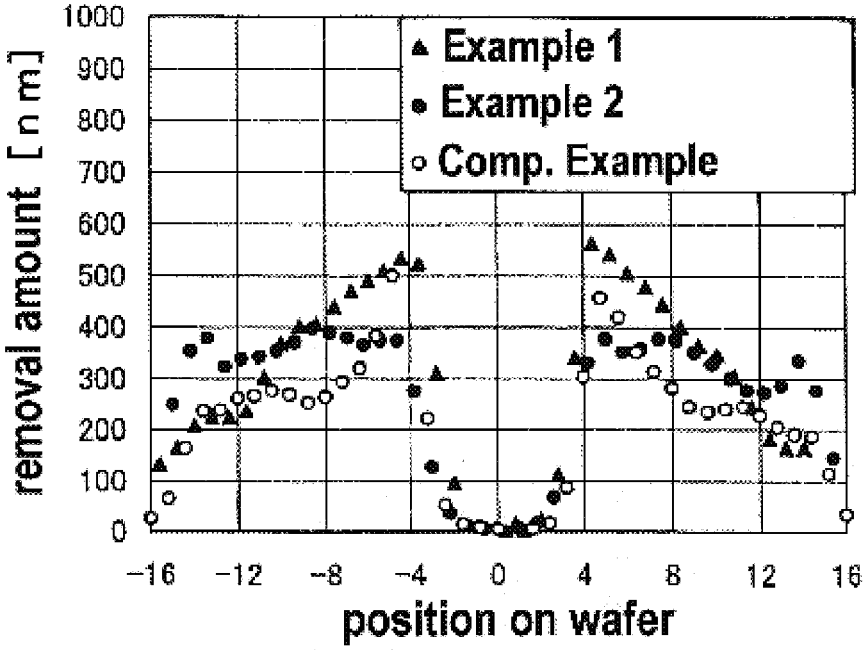
FIG. 21 is a graph showing the relationship between the position on the wafer and the removal amount for the wafer samples of Examples 1 and 2, and Comparative Example.

FIG. 21 shows the processing profiles of a sample processed by using, as the fixed abrasive 312, the #3000 alumina abrasive sheet (Example 1) and the #8000 diamond abrasive sheet (Example 2), together with the processing profile of a sample processed only by electrolytic processing without using a fixed abrasive (Comparative Example). As can be seen from the data in FIG. 21, the processing rate is higher in Examples 1 and 2 compared to the case of solely carrying out electrolytic processing (Comparative Example).

Figure 22:
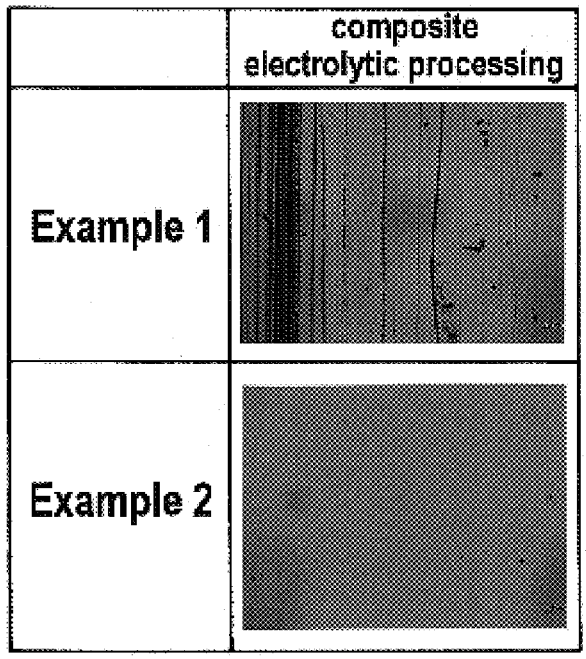
FIG. 22 shows laser micrographs of the wafer surfaces after processing in accordance with Examples 1 and 2.

FIG. 22 shows laser micrographs of the sample (wafer) surfaces after processing in accordance with Examples 1 and 2. As apparent from FIG. 22, the sample of Example 1 has scratches having a depth of about 0.1 μm but in small numbers, while the sample of Example 2 shows a flat processed surface.

Examples 3 and 4

The same sample as used in Examples 1 and 2 was prepared, and processing of the copper plated film was carried out using the composite processing apparatus shown in FIGS. 19 and 20. Processing was carried in the following two-step manner: First, mechanical polishing with the fixed abrasive 312 was carried out by using a processing table 306 having, on the base 310, only the fixed abrasive 312 which is either a #3000 alumina abrasive sheet having a surface roughness of 4.4 μm (Example 3) or a #8000 diamond sheet having a surface roughness of 0.5 μm (Example 4). After completion of the mechanical polishing, electrolytic processing with the processing electrode 318 was carried out by using a processing table 306 having, on the base 310, only the processing electrode 318 and the feeding electrode 320 respectively having, mounted thereon, the ion exchangers 322*a*, 322*b* composed of a two-layer laminate of: an ion exchanger comprising a polyethylene non-woven fabric with a sulfonic acid group introduced by graft polymerization; and a surface sheet-like ion exchanger, Nafion 117 (manufactured by Dupont).

The mechanical polishing with the fixed abrasive 312 [#3000 alumina abrasive sheet (Example 3) or #8000 diamond abrasive sheet (Example 4) was carried out for 30 seconds in ultrapure water having a resistivity of 18 MΩ·cm by rotating the processing table 306 at 200 rpm by the motor 306. The surface of the sample (wafer) after processing was observed under a laser microscope. The subsequent electrolytic processing was carried out for 90 seconds in ultrapure water having a resistivity of 18 MΩ·cm by passing a constant current of 0.3 A between the processing electrode 318 and the feeding electrode 320 while rotating the processing table at 200 rpm. The surface of the sample (wafer) after processing was observed under a laser microscope.

Figure 23:
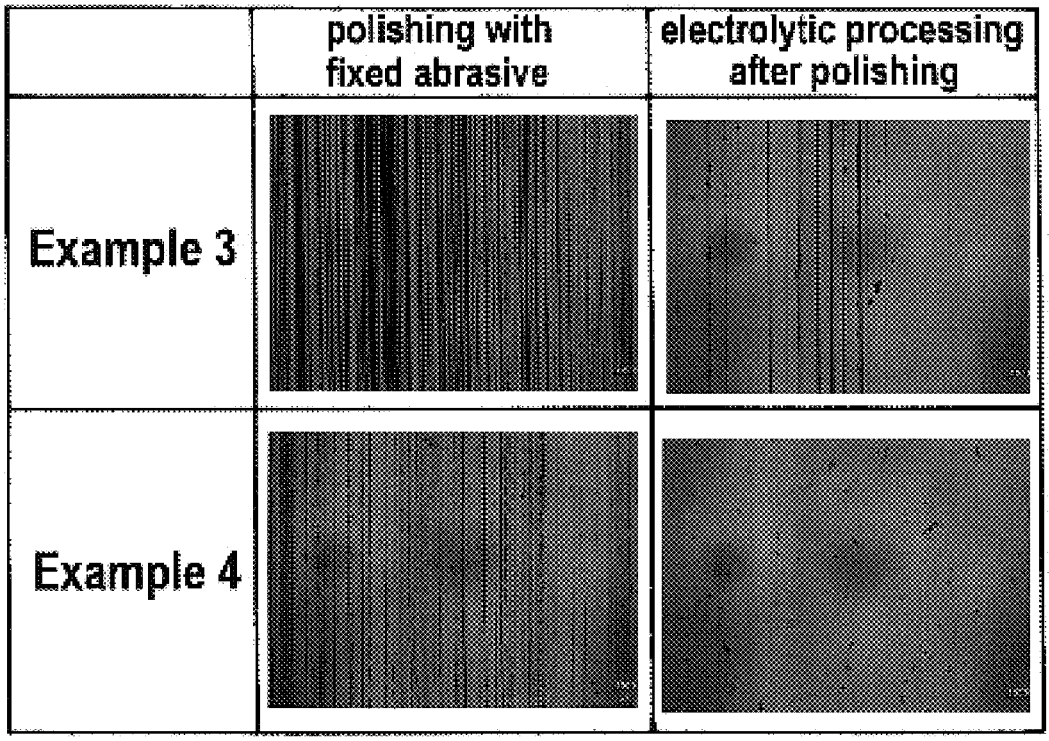
FIG. 23 shows laser micrographs of the wafer surfaces after mechanical processing and after electrolytic processing in accordance with Examples 3 and 4.

FIG. 23 shows the results of the laser microscope observation. As can be seen from FIG. 23, in the case of Example 3, the processing with the fixed abrasive, i.e. the #3000 alumina abrasive polishing sheet, produces scratches having a roughness of 0.2 to 0.27 μm in the surface of the sample (wafer). The number of scratches can be decreased and the roughness of the remaining scratches can be lowered to not more than 0.1 μm by the subsequent electrolytic processing. In the case of Example 4, while the processing with the fixed abrasive, i.e. the #8000 diamond abrasive polishing sheet, produces scratches having a roughness of about 0.1 μm in the surface of the sample, a flat processed surface with almost no scratches left can be obtained by the electrolytic processing.

Though the use of a fixed abrasive (polishing sheet) with a large grain size may increase the processing rate in composite electrolytic processing, scratches cannot be fully removed by electrolytic processing. It is very difficult to remove deep scratches having a depth of not less than 0.5 μm by electrolytic processing into a flat surface. Accordingly, when carrying out composite electrolytic processing of such a workpiece as a copper-plated water for which high processing accuracy and surface flatness are required, using one type of fixed abrasive, it is desirable to use a #8000 or higher fixed abrasive (#8000: abrasive grain size not more than 1 μm and surface roughness 0.5 μm). An ideal process may first employ a relatively rough fixed abrasive, e.g. a #3000 fixed abrasive, in view of the high processing rate, then employ a relatively fine fixed abrasive, e.g. a #8000 fixed abrasive, and carry out finishing only by electrolytic processing without using a fixed abrasive.

While the present invention has been described with reference to the embodiments thereof, it will be appreciated by those skilled in the art that changes could be made to the embodiments within the technical concept of the present invention.

The invention claimed is:

1. A composite processing method comprising:

separately providing a mechanical processing section for processing a surface of a substrate by a mechanical action, and an electrolytic processing section, having a processing electrode with an ion exchanger, for processing the substrate by applying a voltage between the processing electrode and the substrate while keeping the ion exchanger in contact with the substrate;

processing the surface of the substrate with the mechanical and electrolytic processing sections by moving the substrate and the mechanical processing section relative to each other and moving the substrate and the processing electrode relative to each other while keeping the ion exchanger and the mechanical processing section in contact with the substrate such that the electrolytic processing section electrolytically processes the surface and the mechanical processing section removes a passive film formed during processing with the electrolytic processing section; and re-processing the surface with the electrolytic processing section after said processing of the surface with the mechanical and electrolytic processing sections.

* * * * *